US011355893B2

(12) United States Patent
Takada

(10) Patent No.: US 11,355,893 B2
(45) Date of Patent: Jun. 7, 2022

(54) TERMINAL CRIMPING METHOD

(71) Applicant: Yazaki Corporation, Tokyo (JP)

(72) Inventor: Kazuhiko Takada, Makinohara (JP)

(73) Assignee: Yazaki Corporation, Tokyo (JP)

( * ) Notice: Subject to any disclaimer, the term of this patent is extended or adjusted under 35 U.S.C. 154(b) by 398 days.

(21) Appl. No.: 16/139,406

(22) Filed: Sep. 24, 2018

(65) Prior Publication Data

US 2019/0097374 A1 Mar. 28, 2019

(30) Foreign Application Priority Data

Sep. 26, 2017 (JP) ..... JP2017-185002

(51) Int. Cl.
*H01R 43/052* (2006.01)
*H01R 43/28* (2006.01)
*H01R 43/055* (2006.01)

(52) U.S. Cl.
CPC ..... *H01R 43/052* (2013.01); *H01R 43/055* (2013.01); *H01R 43/28* (2013.01)

(58) Field of Classification Search
CPC .... H01R 43/052; H01R 43/055; H01R 43/28; H01R 43/20; H01R 43/048
See application file for complete search history.

(56) References Cited

U.S. PATENT DOCUMENTS 3,599,472 A * 8/1971 Koletsos ..... H01R 43/048 72/424
4,649,636 A * 3/1987 Arbogast, Jr. ..... H01R 43/28 29/749
4,982,830 A * 1/1991 Strong ..... H01R 43/01 198/349.6
5,016,345 A * 5/1991 Aligue ..... H01R 43/28 211/60.1
5,027,636 A * 7/1991 Dassance ..... H01R 43/055 72/423
5,432,995 A * 7/1995 Takenami ..... H01R 43/048 29/33 M
5,606,795 A 3/1997 Ohba et al.
5,659,949 A 8/1997 Ohba et al.
5,913,934 A 6/1999 Inoue et al.
6,141,867 A * 11/2000 Fukada ..... H01R 43/20 29/33 M
6,486,677 B2 * 11/2002 Takada ..... G01R 31/69 324/539

(Continued)

FOREIGN PATENT DOCUMENTS

CN 105210244 A 12/2015
EP 3422492 A1 11/2014
JP S62-067485 U 4/1987

(Continued)

*Primary Examiner* — Jeffrey T Carley

(74) *Attorney, Agent, or Firm* — Banner & Witcoff, Ltd.

(57) ABSTRACT

A terminal crimping process includes using a plurality of terminal holders to respectively hold various types of the terminal fittings and arranging the terminal holders in a terminal magazine. The terminal magazine is detachably installed on the terminal feeding mechanism. The terminal feeding process further includes moving the terminal magazine to convey the terminal fittings held on the terminal holders to the crimping position, and subsequently crimping the terminal fitting with a wire disposed therein.

5 Claims, 20 Drawing Sheets

(56) References Cited

U.S. PATENT DOCUMENTS

| | | | | |
|---|---|---|---|---|
| 2004/0007042 | A1* | 1/2004 | Imgrut | H01R 43/055 72/412 |
| 2016/0226208 | A1* | 8/2016 | Stull | H01R 43/048 |

FOREIGN PATENT DOCUMENTS

| | | | | |
|---|---|---|---|---|
| JP | H06-223646 | A | 8/1994 | |
| JP | H10-012349 | A | 1/1998 | |
| JP | 2005-135822 | A | 5/2005 | |
| JP | 2014-055903 | A | 3/2014 | |
| KR | 101487630 | B1 * | 1/2015 | H01R 43/055 |
| WO | 2014181729 | A1 | 11/2014 | |
| WO | WO-2016128331 | A1 * | 8/2016 | H01R 43/055 |

* cited by examiner

TERMINAL CRIMPING METHOD

CROSS-REFERENCES TO RELATED APPLICATIONS

This application is based on and claims priority from Japanese Patent Application No. 2017-185002 filed on Sep. 26, 2017, the entire contents of which are incorporated herein by reference.

FIELD

One or more embodiments of the present invention relate to a terminal crimping device and a terminal crimping method which crimp and connect a terminal fitting to an end of an electric wire.

BACKGROUND

In manufacturing wire harnesses, there is a crimping process of crimping terminal fittings to ends of electric wires using a crimping machine installed on a working table (for example, refer to JP-H06-223646).

As the crimping machine used in this crimping process, a multi-crimping device is known which includes a plurality of pairs of anvils and crimpers corresponding to a plurality of types of terminal fittings, moves the selected pair of anvil and crimper to a common crimping position, and crimps a terminal fitting which is a processing target to an electric wire (for example, refer to JP-A-2005-135822 and JP-A-H10-012349).

SUMMARY

Incidentally, the terminal fittings fed to the crimping machine of the related art are generally fed from a reel wound in a state of a chain terminal. For this reason, when various types of terminal fittings are crimped to the electric wires, a feeder or a reel for feeding the terminal fittings should be installed for each type of terminal fitting, resulting in an increase in size of the device.

One or more embodiments of the present invention have been made in view of the above circumstances, and an object thereof is to provide a terminal crimping device and a terminal crimping method capable of crimping a plurality of terminal fittings, and furthermore making the device small.

One or more embodiments of the present invention provide a terminal crimping device defined in the following items (1) and (2).

(1) A terminal crimping device for crimping a terminal fitting disposed at a crimping position to an electric wire, the terminal crimping device including: an anvil disposed below the crimping position; a crimper disposed above the crimping position; a pressing mechanism configured to press down the crimper to crimp the terminal fitting to the electric wire using the anvil and the crimper; and a terminal feeding mechanism configured to feed the terminal fitting to the crimping position, wherein a terminal magazine in which a plurality of terminal holders configured to respectively hold various types of the terminal fittings are arranged is detachably installed on the terminal feeding mechanism, and wherein the terminal feeding mechanism moves the terminal magazine to convey the terminal fittings held on the terminal holders to the crimping position.

(2) The terminal crimping device according to (1) above including: a multi-applicator including a plurality of pairs, each of the pairs including the anvil and the crimper, configured to crimp a plurality of types of the terminal fittings to the electric wires, wherein the multi-applicator is configured such that the pair of anvil and crimper corresponding to the terminal fitting fed to the crimping position is selected to be disposed at the crimping position.

According to the terminal crimping device having the above configuration (1), the terminal magazine in which the various terminal fittings are held on the plurality of terminal holders is mounted on the terminal feeding mechanism, and thereby the various terminal fittings held on the terminal holders are conveyed to the crimping position and are sequentially crimped to the electric wires. Therefore, there is no need to install a plurality of feeders for feeding the terminal fittings and a plurality of reels around which a chain terminal is wound for each type of terminal fittings, so that the terminal crimping device can be reduced in size, and an installation space can be reduced.

According to the terminal crimping device having the above configuration (2), among the plurality of pairs of anvils and crimpers provided in the multi-applicator, the pair of anvil and crimper corresponding to each of the terminal fittings to be crimped is selected, and each of the terminal fittings fed to the crimping position is crimped to the electric wire by the selected anvil and crimper. Therefore, the plurality of types of terminal fittings can be rapidly crimped to the electric wires, and productivity and quality can be improved even in the production of many kinds in small quantities.

One or more embodiments of the present invention provide a terminal crimping method defined in the following item (3).

(3) A terminal crimping method including: holding a terminal fitting to be crimped to an electric wire on at least one terminal holder mounted in a terminal magazine; moving the terminal magazine in which the terminal fitting is held on the terminal holder toward a crimping position along a terminal conveying direction; and clamping an electric wire connecting part of the terminal fitting disposed at the crimping position on an end of the electric wire from which a conductor is exposed with a pair of anvil and crimper.

According to the terminal crimping method of (3) above, the terminal magazine in which the various terminal fittings are held on the plurality of terminal holders is moved to the crimping position, and thereby the terminal fittings are sequentially crimped to the electric wires. Therefore, there is no need to install a plurality of feeders for feeding the terminal fittings and a plurality of reels around which a chain terminal is wound for each type of terminal fittings, so that the terminal crimping device can be reduced in size, and an installation space can be reduced.

According to one or more embodiments of the present invention, it is possible to provide a terminal crimping device and a terminal crimping method capable of crimping a plurality of terminal fittings, and furthermore making the device small.

One or more embodiments of the present invention have been briefly described above. Further, a detailed embodiment of the invention is described below with reference to the attached drawings, and thereby details will be further clarified.

BRIEF DESCRIPTION OF DRAWINGS

FIGS. 7A and 7B are views illustrating the terminal holder, wherein FIG. 7A is a perspective view of a state in which a locking plate is opened and FIG. 7B is a perspective view of a state in which the locking plate is closed;

FIGS. 8A and 8B are views illustrating the terminal holder, wherein FIG. 8A is a perspective view of the state in which the locking plate is opened when viewed from the lower side and FIG. 8B is a perspective view of the state in which the locking plate is closed when viewed from the lower side;

DETAILED DESCRIPTION

Hereinafter, an embodiment according to the present invention will be described with reference to the drawings.

First, terminal fittings connected to electric wires by a terminal crimping device and a terminal crimping method according to the present embodiment will be described.

Figure 1:
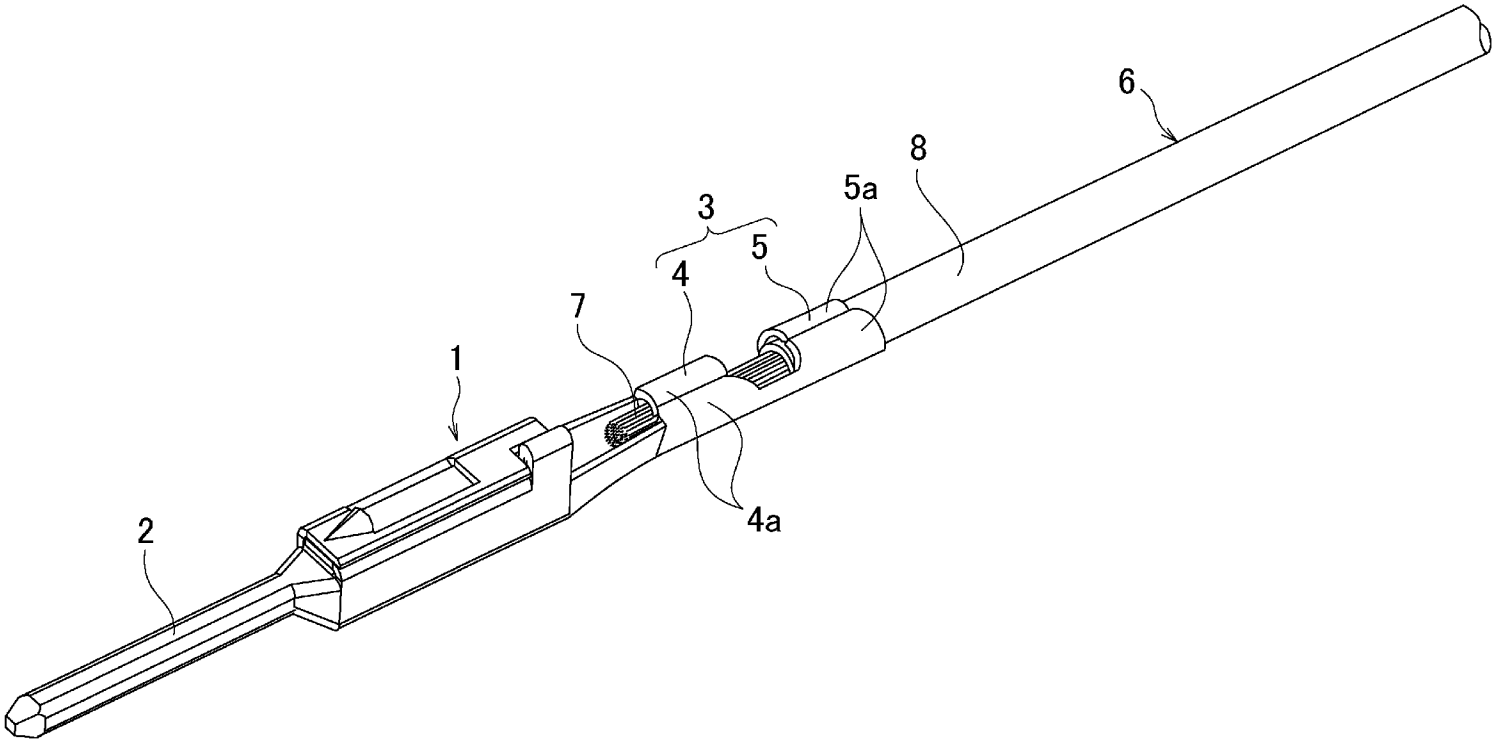
FIG. 1 is a perspective view illustrating an example of a terminal fitting crimped to an electric wire.

FIG. 1 is a perspective view illustrating an example of a terminal fitting 1 crimped to an electric wire 6.

As illustrated in FIG. 1, a terminal fitting 1 is for instance crimped and electrically connected to an end of an electric wire 6 that constitutes a wire harness distributed to a vehicle such as an automobile. The electric wire 6 is a sheathed electric wire that includes a conductor 7 and a sheath 8 that covers the conductor 7 and is formed of a resin.

The terminal fitting 1 includes an electric connecting part 2 in the front thereof, and an electric wire connecting part 3 in the rear thereof. The terminal fitting 1 is formed by performing pressing (punching and bending) on a base material formed of a plate of a conductive metal such as copper or its alloy or aluminum or its alloy. An electric connecting part of a terminal fitting of a connection counterpart is electrically connected to the electric connecting part 2.

The electric wire connecting part 3 is crimped and electrically connected to the end of the electric wire 6. The electric wire connecting part 3 is a conductor crimping part 4 at a front side thereof, and a sheath crimping part 5 at a rear side thereof. The conductor crimping part 4 includes a pair of conductor crimping pieces 4*a*, and the sheath crimping part 5 includes a pair of sheath crimping pieces 5*a*. The pair of conductor crimping pieces 4*a* of the conductor crimping part 4 is clamped on the conductor 7, which is exposed at the end of the electric wire 6, from both sides, and the pair of sheath crimping pieces 5*a* of the sheath crimping part 5 is clamped on a portion of the sheath 8 (a sheath portion) at the end of the electric wire 6. Thereby, the terminal fitting 1 is crimped and electrically connected to the electric wire 6.

The terminal fitting 1 includes a plurality of types of terminal fittings, each of which includes the electric connecting part 2 that can be connected to the electric connecting part of the terminal fitting of the connection counterpart and has various sizes and shapes. In addition, the terminal fitting 1 includes a plurality of types of terminal fittings, each of which includes the electric wire connecting part 3 corresponds to various electric wires 6 that are different from each other in terms of diameters and types of the conductor 7 and the sheath 8.

The terminal crimping device 10 according to the present embodiment is a terminal crimping device that can crimp and connect the electric wires 6 to the plurality of types of terminal fittings 1 (hereinafter also referred to as terminal fittings 1*a* to 1*d*) (see FIG. 10). Hereinafter, the terminal crimping device 10 according to the present embodiment will be described.

Figure 2:
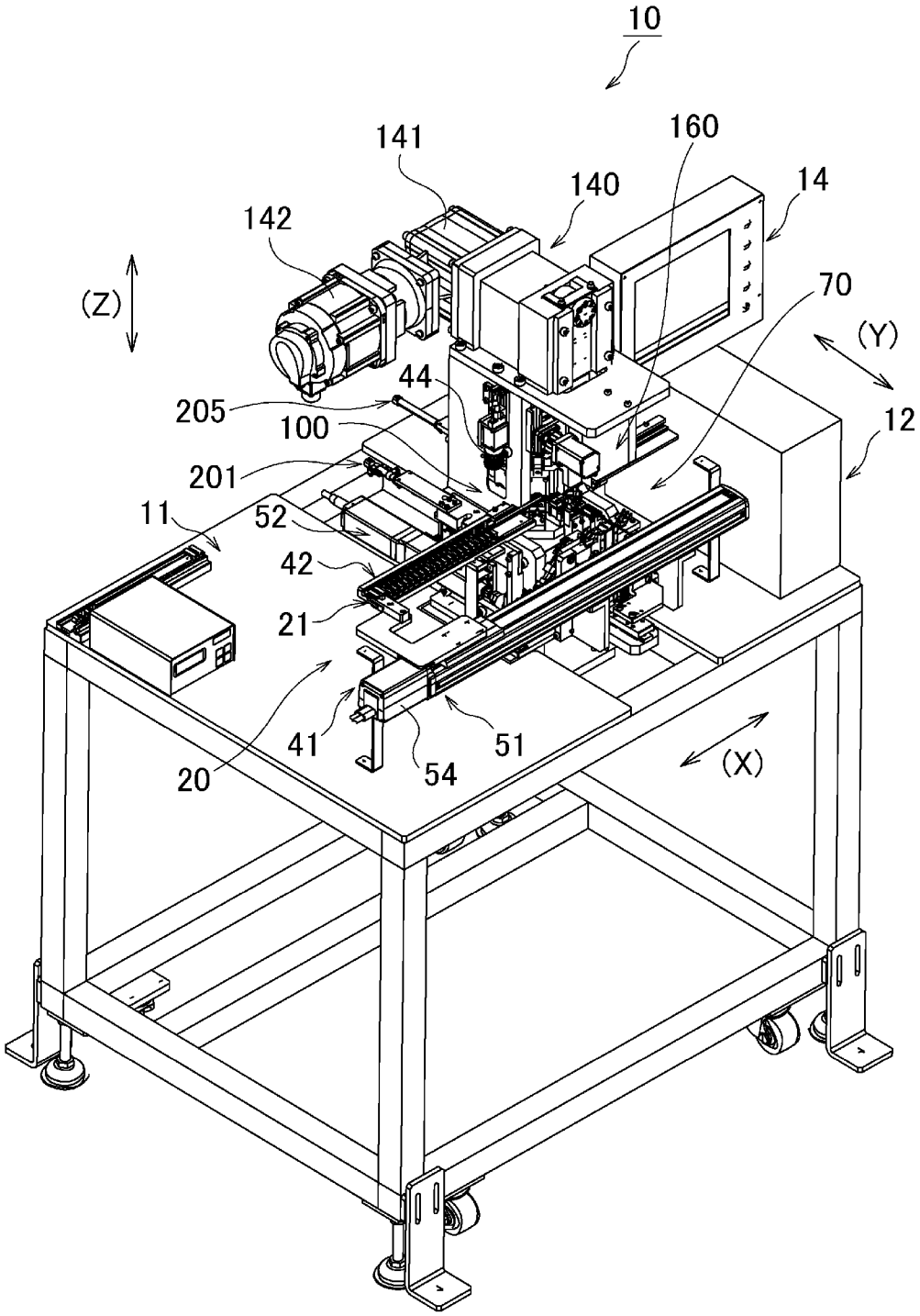
FIG. 2 is a perspective view of a terminal crimping device according to the present embodiment.
Figure 3:
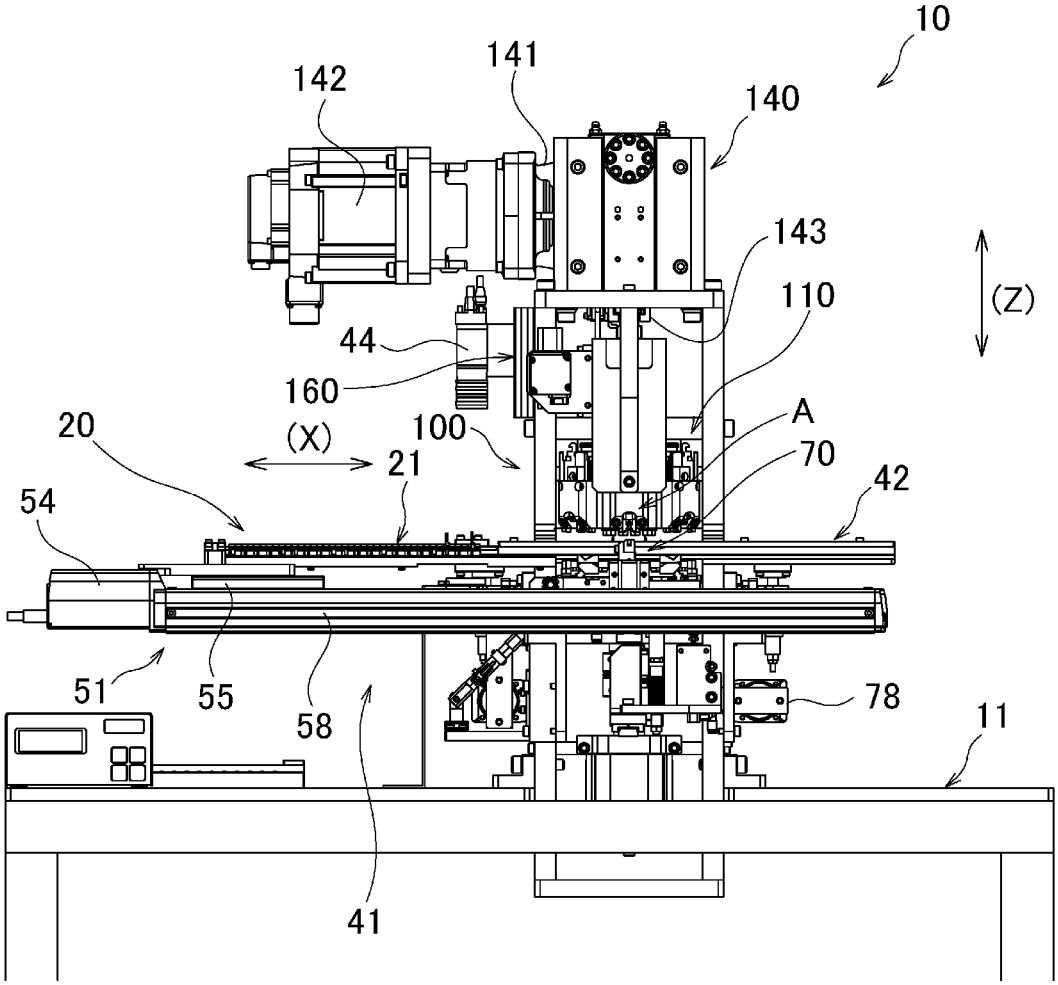
FIG. 3 is a front view of the terminal crimping device according to the present embodiment.
Figure 4:
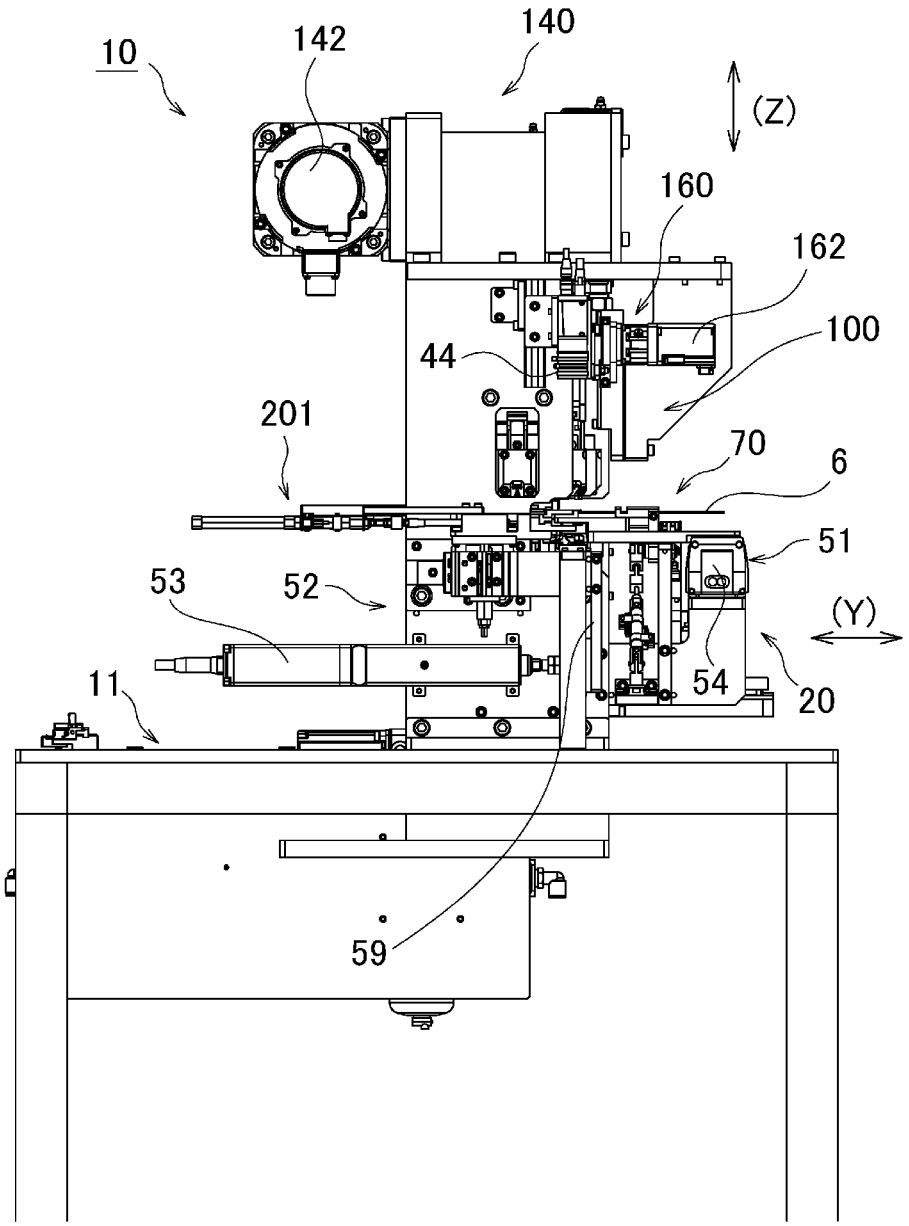
FIG. 4 is a left side view of the terminal crimping device according to the present embodiment.

FIGS. 2 to 4 are a perspective view, a front view, and a left side view of the terminal crimping device 10 according to the present embodiment.

As illustrated in FIGS. 2 to 4, the terminal crimping device 10 includes a terminal feeding unit 20, an electric wire feeding unit 70, and a terminal crimping unit 100. The terminal feeding unit 20, the electric wire feeding unit 70, and the terminal crimping unit 100 are fixed on a mount 11.

The terminal crimping device 10 includes a control device 12 and an operation panel 14 for controlling driving of the terminal feeding unit 20, the electric wire feeding unit 70, and the terminal crimping unit 100, and the control device 12 and the operation panel 14 are fixed on the mount 11.

In the terminal crimping device 10, the end of the electric wire 6 from which the conductor 7 is exposed is fed to the terminal fitting 1, which is fed to a crimping position A by the terminal feeding unit 20, by the electric wire feeding unit 70. The terminal crimping unit 100 clamps the conductor crimping part 4 and the sheath crimping part 5 of the terminal fitting 1 fed to the crimping position A, and thereby the terminal fitting 1 is crimped and electrically connected to the end of the electric wire 6.

Figure 5:
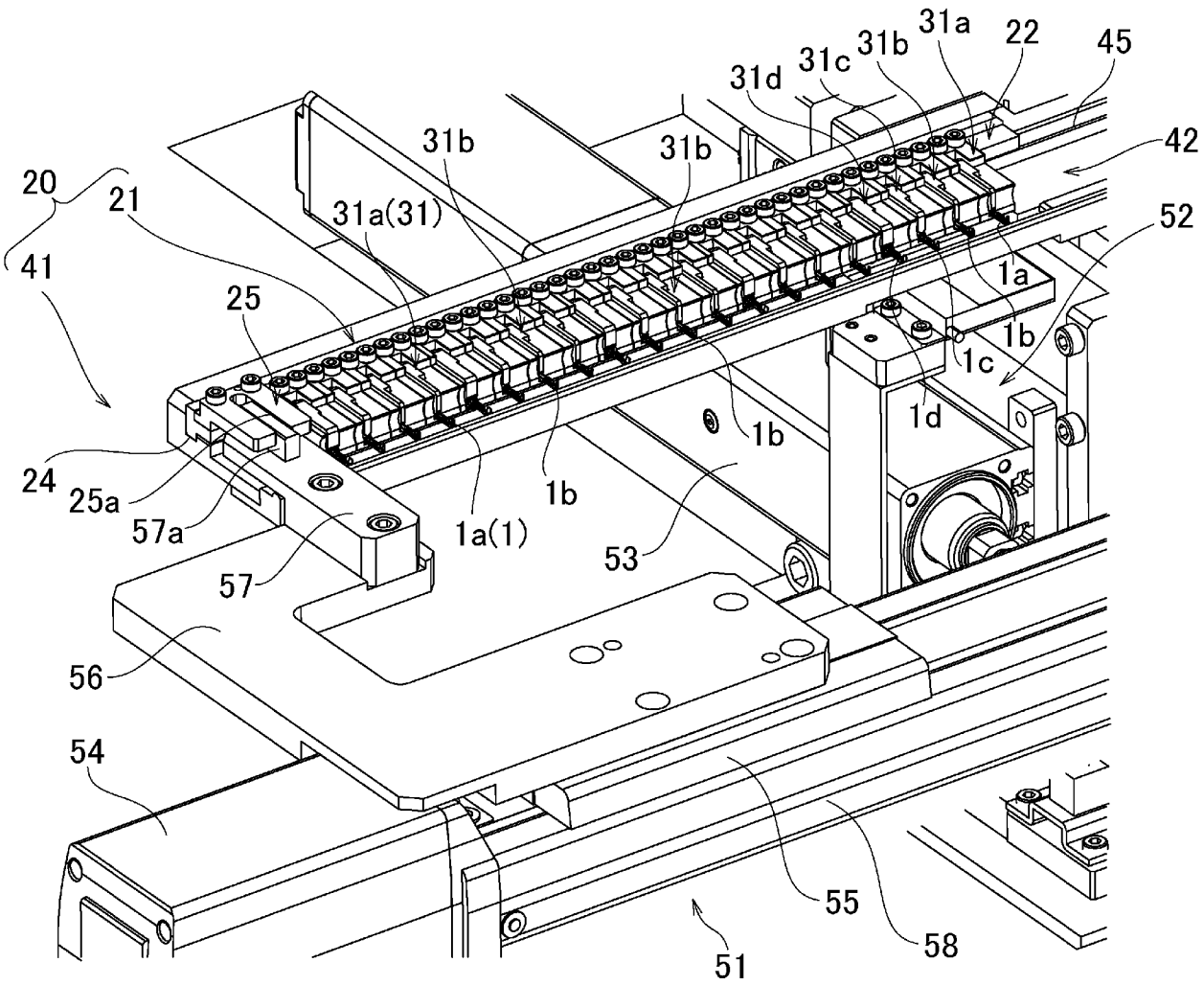
FIG. 5 is a perspective view of a terminal magazine set to a slide rail.
Figure 6:
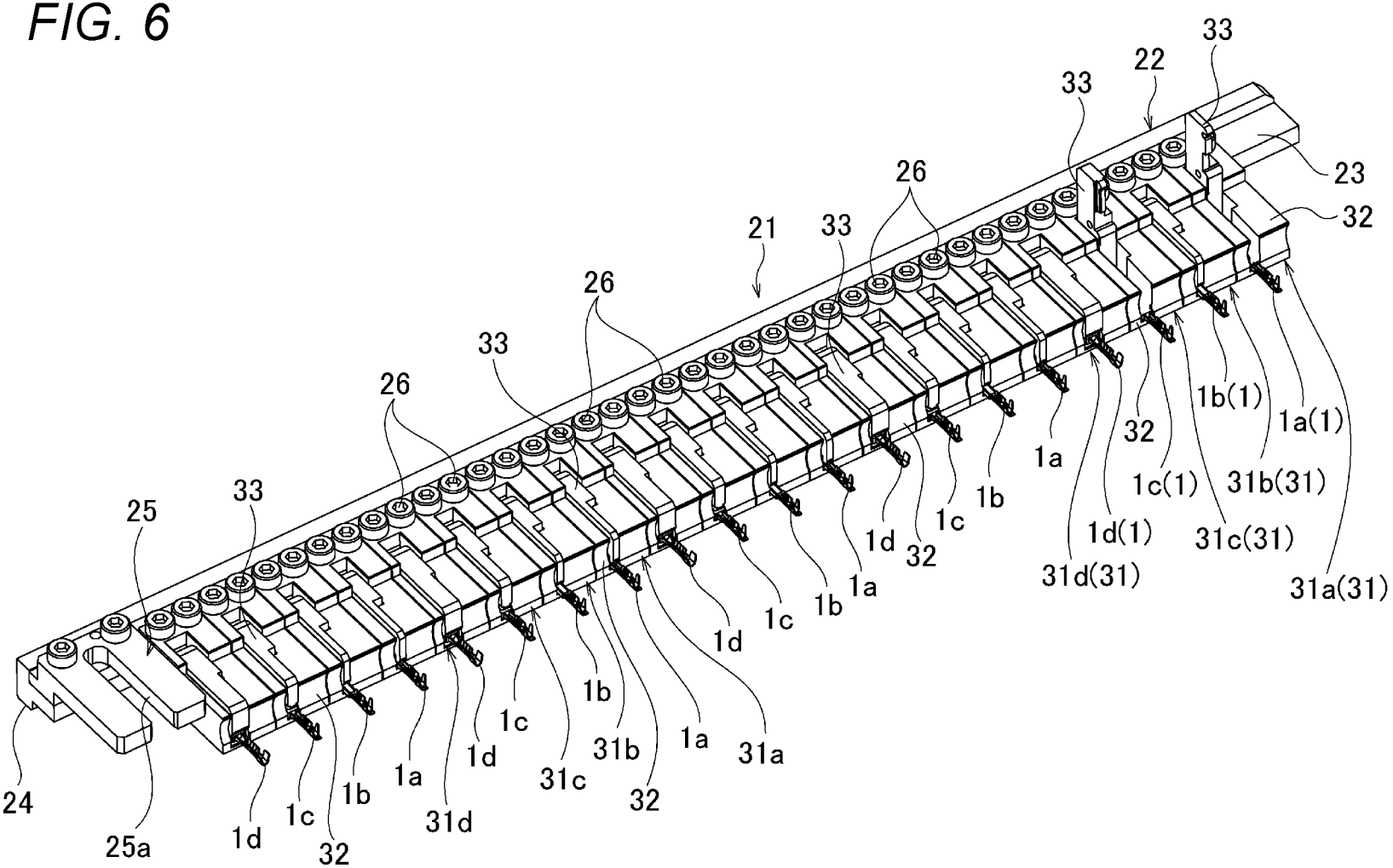
FIG. 6 is a perspective view of the terminal magazine in which the terminal fittings are held on terminal holders.
Figure 7A:
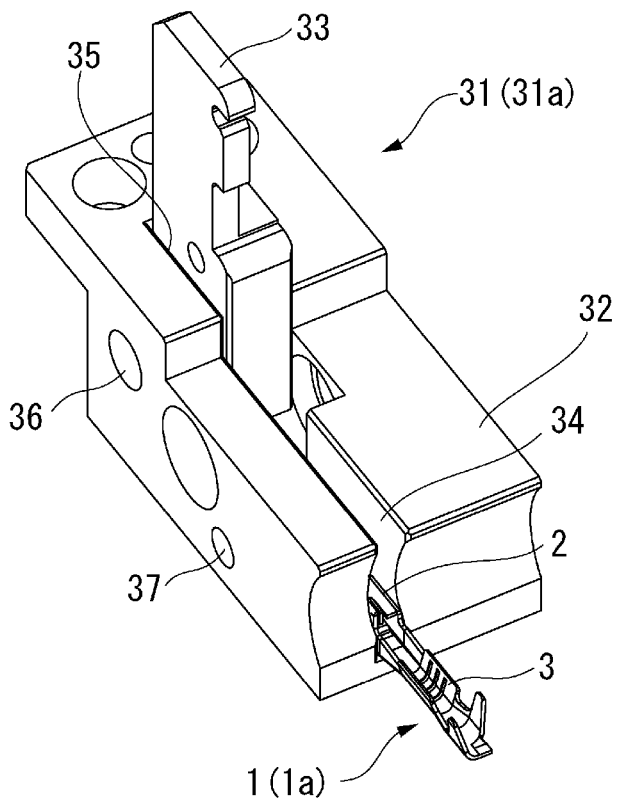
Figure 7B:
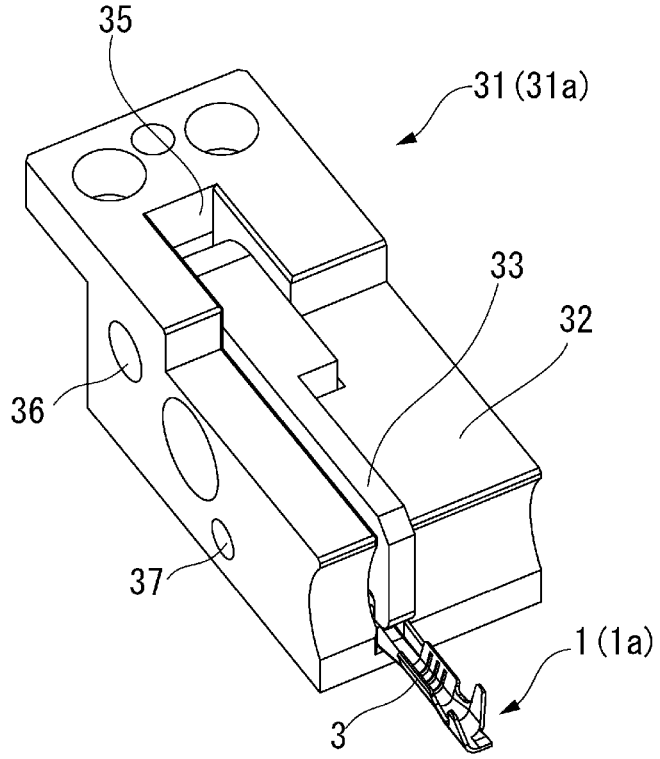

FIG. 5 is a perspective view of a terminal magazine 21 set to a slide rail 42, and FIG. 6 is a perspective view of the terminal magazine 21 in which the terminal fittings 1 are held on terminal holders 31.

As illustrated in FIGS. 2 and 5, the terminal feeding unit 20 includes a terminal magazine 21 and a terminal feeding mechanism 41. The terminal magazine 21 is detachably mounted on the terminal feeding mechanism 41. The terminal magazine 21 holds the plurality of terminal fittings 1 in an aligned state.

The terminal feeding mechanism 41 horizontally moves the terminal magazine 21 in a terminal conveying direction (X), and thereby the terminal fitting 1, which is designated from among the plurality of terminal fittings 1 held by the terminal magazine 21 and is a crimping target, is conveyed and fed to the crimping position A.

As illustrated in FIG. 6, the terminal magazine 21 includes a support 22 and a plurality of terminal holders 31 (hereinafter also referred to as terminal holders 31*a* to 31*d*). The support 22 is formed in a long shape and includes a step 23 formed on an upper surface thereof. The support 22 includes a projection 24 extending along a lower surface thereof in a longitudinal direction. A two-forked engaging member 25 including a slit 25*a* is fixed in the vicinity of one end of the support 22.

Since the plurality of terminal holders 31*a* to 31*d* hold the plurality of types of terminal fittings 1*a* to 1*d* respectively, they are aligned on the step 23 of the support 22 and are detachably mounted by screws 26. These terminal holders 31*a* to 31*d* hold the electric connecting parts 2 of the corresponding terminal fittings 1*a* to 1*d*, and thereby put the electric wire connecting parts 3 of the terminal fittings 1*a* to 1*d* in a state of protruding laterally. Thereby, the terminal fittings 1*a* to 1*d* held by the terminal holders 31*a* to 31*d* are configured such that the laterally protruding electric wire connecting parts 3 are arranged in parallel at intervals in the longitudinal direction of the support 22. The plurality of types (four types in the present embodiment) of terminal holders 31*a* to 31*d* are prepared in response to shapes and sizes the electric connecting parts 2 of the terminal fittings 1*a* to 1*d*. Thereby, the terminal holders 31*a* to 31*d* corresponding to the various terminal fittings 1*a* to 1*d* are fixed to the support 22.

FIGS. 7A to 9 are perspective views and an exploded perspective view for illustrating the terminal holder 31 (31*a*) according to the present embodiment.

As illustrated in FIGS. 7A to 9, the terminal holder 31 (31*a*) includes a holder block 32 and a locking plate 33. A holding groove 34 is formed in the holder block 32, and the electric connecting part 2 of the terminal fitting 1 (1*a*) is housed in the holding groove 34. The locking plate 33 is inserted into a window part 35 that is formed at a rear side of the holding groove 34 of the holder block 32, and is pivotably supported by a pivotal pin 36. Thereby, the locking plate 33 of the terminal holder 31 (31*a*) is pivoted, and thereby an upper opening of the holding groove 34 is opened-closed. The locking plate 33 is pivoted to close the upper opening of the holding groove 34 in a state in which the electric connecting part 2 of the terminal fitting 1 (1*a*) is disposed in the holding groove 34. Thereby, the electric connecting part 2 of the terminal fitting 1 (1*a*) is held by the terminal holder 31 (31*a*), and the electric wire connecting part 3 is in the state of protruding laterally from the terminal holder 31 (31*a*).

A butting pin 37 is inserted into the holder block 32 to cross the holding groove 34. A tip of the electric connecting part 2 of the terminal fitting 1 housed in the holding groove 34 comes into contact with the butting pin 37. Thereby, the terminal fitting 1 is held by the terminal holder 31 in a state in which the electric wire connecting part 3 thereof protrudes with a predetermined protrusion amount. The butting pin 37 has a different insertion position in the holder blocks 32 depending on the types of the terminal fittings 1*a* to 1*d* that are held on the terminal holders 31*a* to 31*d*. Thereby, irrespective of the types of the terminal fittings 1*a* to 1*d*, protrusion dimensions of the electric wire connecting parts 3 from the holder blocks 32 are approximately the same.

Figure 8A:
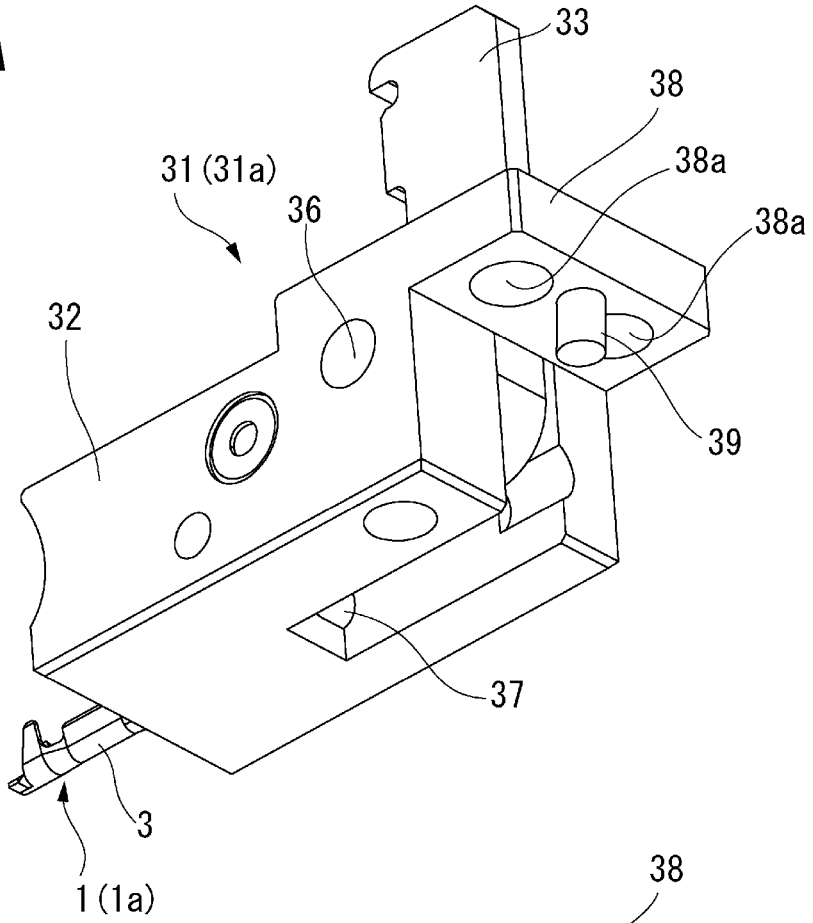
Figure 8B:
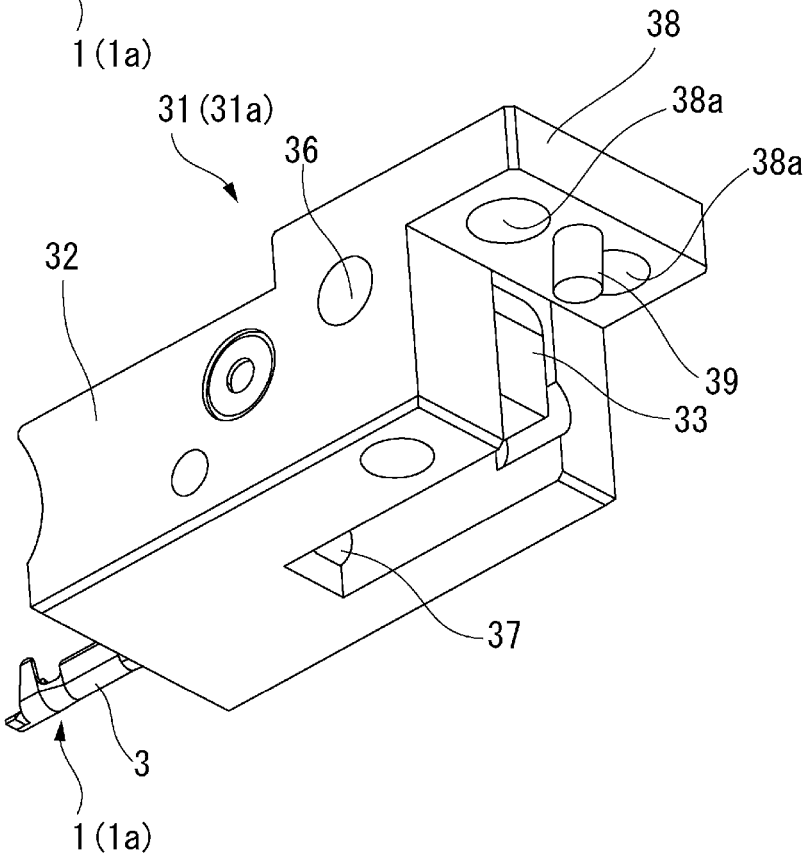
Figure 9:
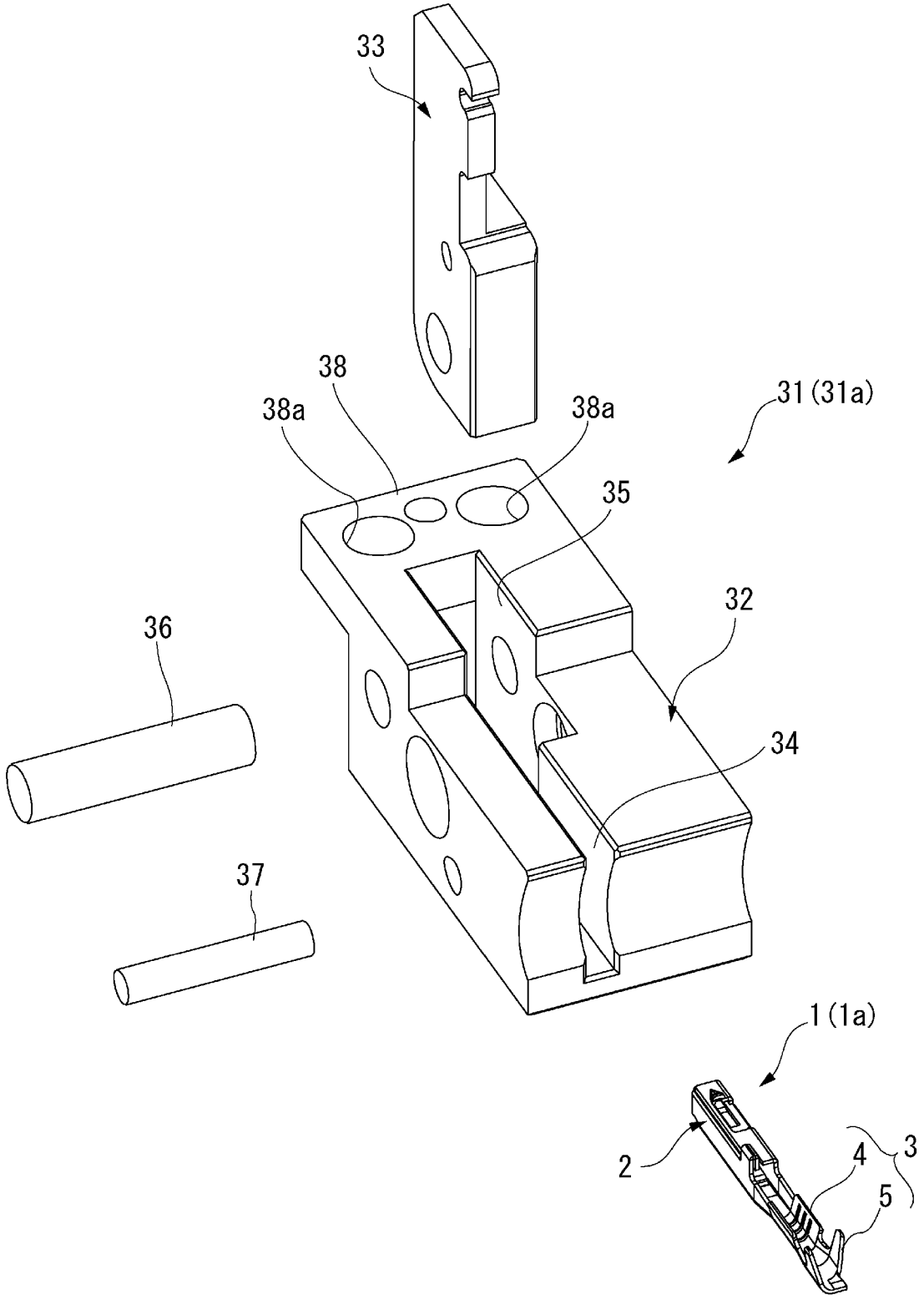
FIG. 9 is an exploded perspective view of the terminal holder.

As illustrated in FIG. 8, a fixing piece 38 protruding backward is formed at an upper portion of the holder block 32 of the terminal holder 31. A pair of holes 38*a* is formed in the fixing piece 38, and the screws 26 are inserted into the holes 38*a* and are screwed into screw holes (not shown) of the support 22, so that the terminal holder 31 (31*a*) is fixed to the support 22. A positioning pin 39 protruding downward is provided on the fixing piece 38, and the positioning pin 39 is inserted into a positioning hole (not shown) of the support 22, so that the terminal holder 31 (31*a*) is positioned for the support 22.

Figure 10:
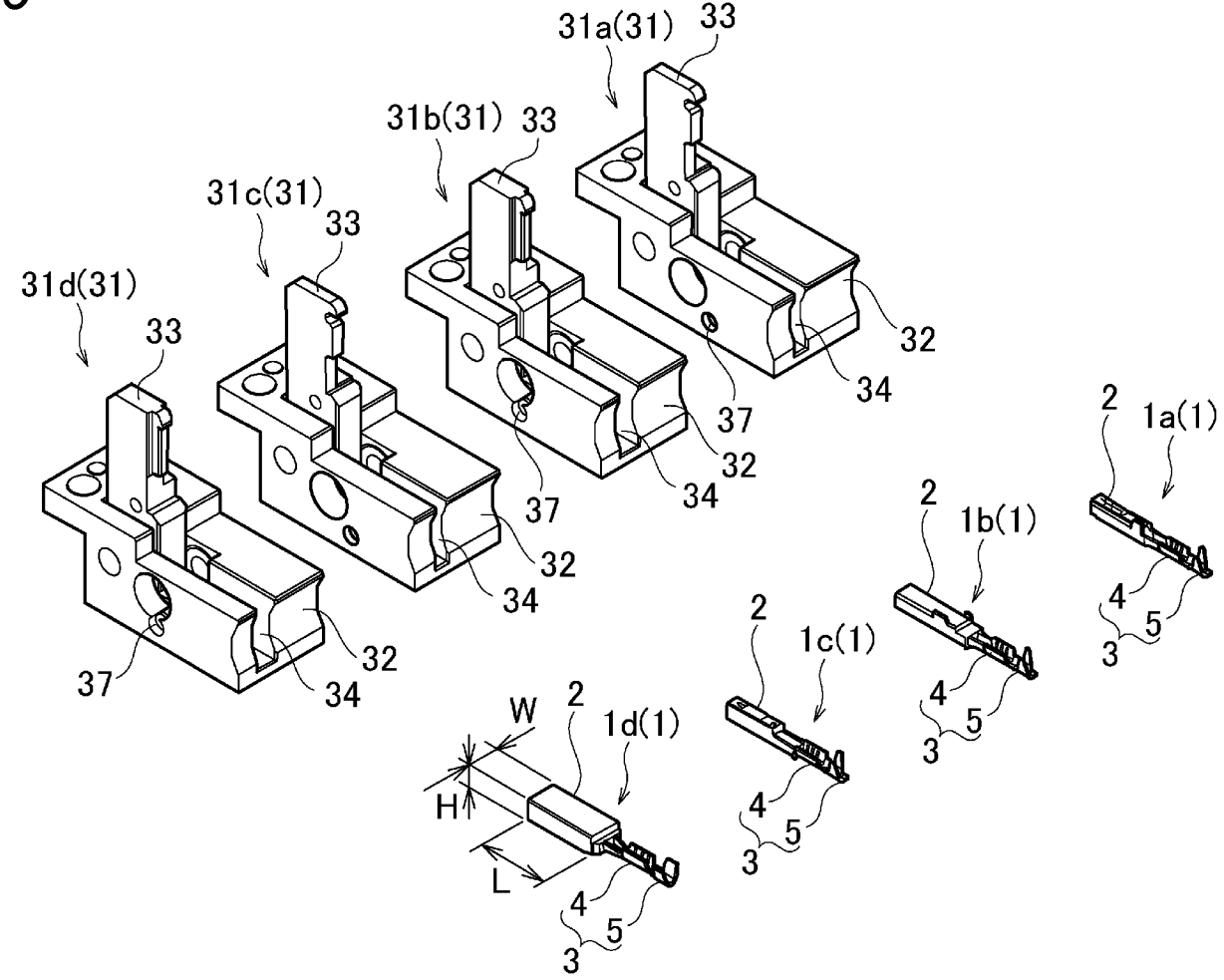
FIG. 10 is a perspective view of various terminal fittings and various terminal holders.
Figure 11:
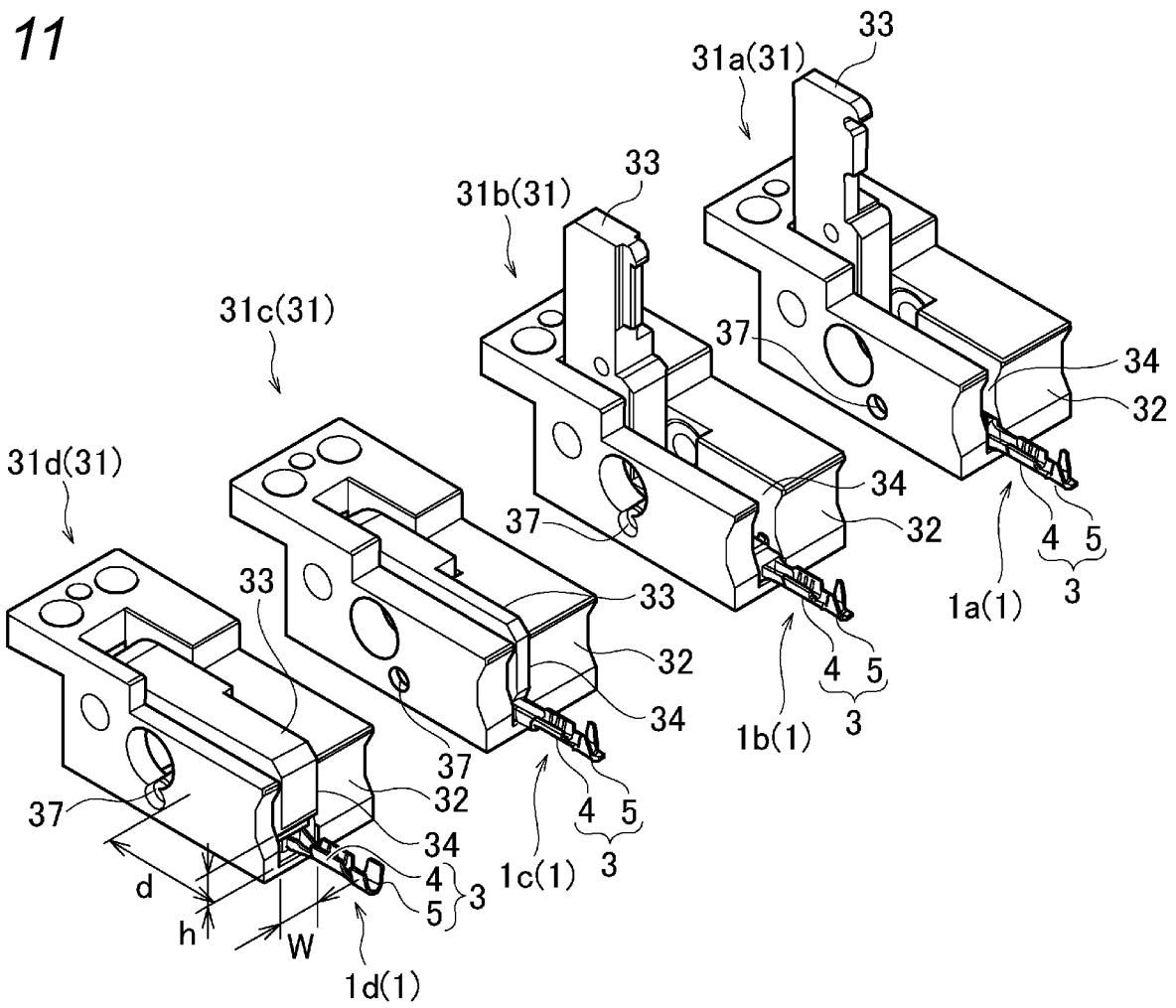
FIG. 11 is a perspective view of various terminal holders on which various terminal fittings are held.

FIG. 10 is perspective views of the various terminal fittings 1*a* to 1*d* and the various terminal holders 31*a* to 31*d*. FIG. 11 is perspective views of the various terminal holders 31*a* to 31*d* that hold the various terminal fittings 1*a* to 1*d*.

As illustrated in FIGS. 10 and 11, in the terminal crimping device 10 according to the present embodiment, the plurality of types of terminal fittings 1*a* to 1*d* are crimped and connected to the electric wires 6. For example, the terminal fittings 1*a* to 1*d* may be different in width dimension W, height dimension H, length dimension L, or shape of the electric connecting part 2. In addition, the terminal fittings 1*a* to 1*d* may include either the electric wire connecting parts 3 of shapes or sizes corresponding to the various electric wires 6 that are different in diameter or type of the conductor 7 and the sheath 8, or the electric wire connecting parts 3 of shapes or sizes corresponding to crimping of the plurality of electric wires 6.

Therefore, a plurality of types of terminal holders corresponding to the plurality of types of terminal fittings 1*a* to 1*d* are prepared as the terminal holders 31*a* to 31*d* that hold the terminal fittings 1*a* to 1*d*. To be specific, the terminal holders 31*a* to 31*d* including the holding grooves 34 that are different in width dimension, depth dimension, length dimension, or shape corresponding to the electric connecting parts 2 of the various terminal fittings 1*a* to 1*d* and including the locking plates 33 corresponding to the holding grooves 34 are prepared. That is, a width dimension w, height dimension h, length dimension d, and shape of the holding space of the electric connecting part 2 which is formed when the locking plate 33 is closed have dimensions and shapes corresponding to the terminal fittings 1*a* to 1*d* to be held by the terminal holders 31*a* to 31*d*.

The electric connecting parts 2 of the corresponding types of terminal fittings 1*a* to 1*d* are housed in the holding grooves 34 of the terminal holders 31*a* to 31*d*, and are brought into contact with the butting pins 37. In this state, the locking plates 33 are pivoted to close the upper openings of the holding grooves 34. Thereby, the electric connecting parts 2 are held by the terminal holders 31*a* to 31*d*, and the electric wire connecting parts 3 are in the state of protruding laterally from the terminal holders 31*a* to 31*d*. The terminal holders 31*a* to 31*d* that hold the corresponding terminal fittings 1*a* to 1*d* are assembled to the terminal magazine 21.

Figure 12:
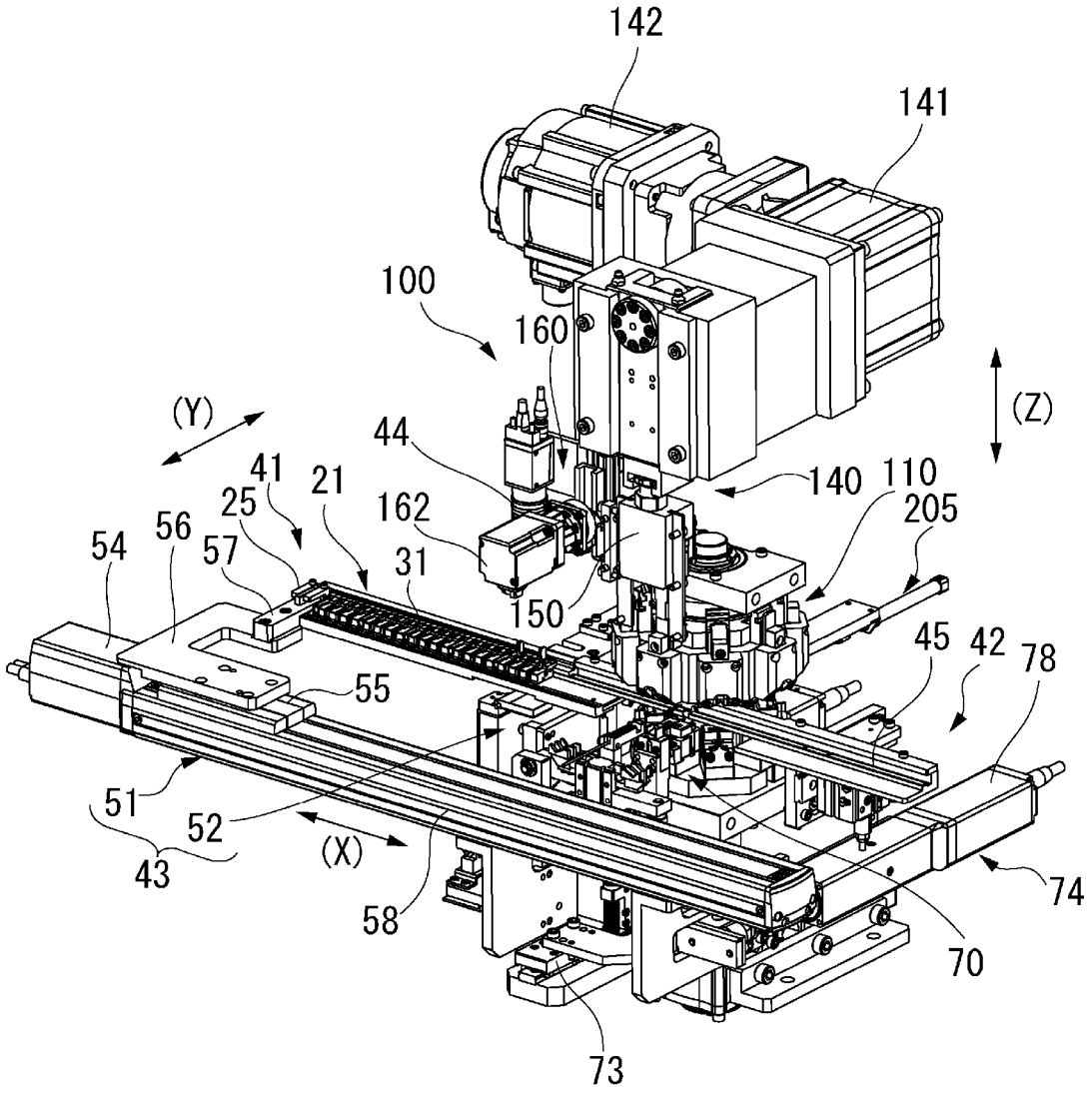
FIG. 12 is a perspective view of principal constituent portions of the terminal crimping device according to the present embodiment when viewed from the right side.
Figure 13:
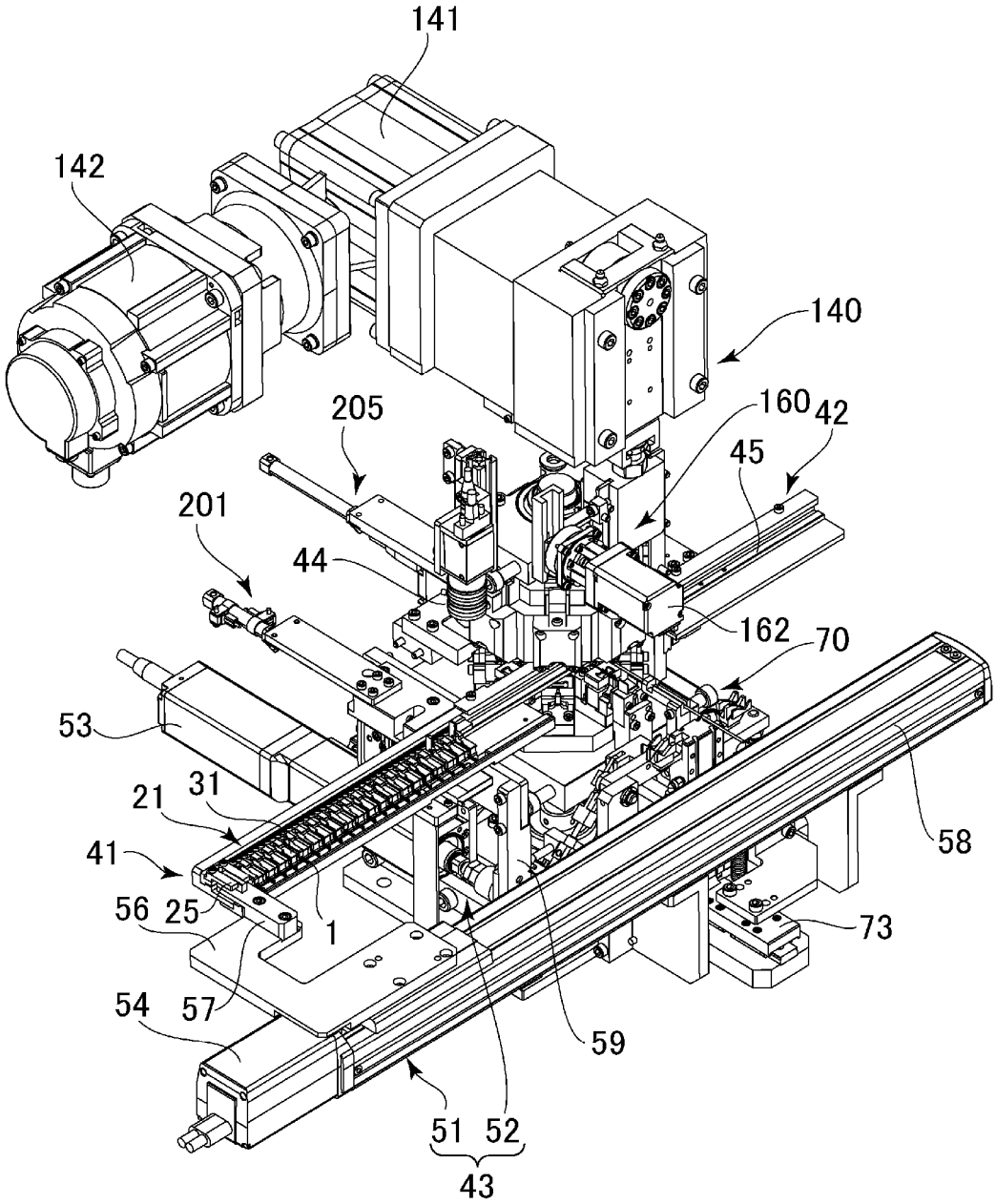
FIG. 13 is a perspective view of the principal constituent portions of the terminal crimping device according to the present embodiment when viewed from the left side.
Figure 14:
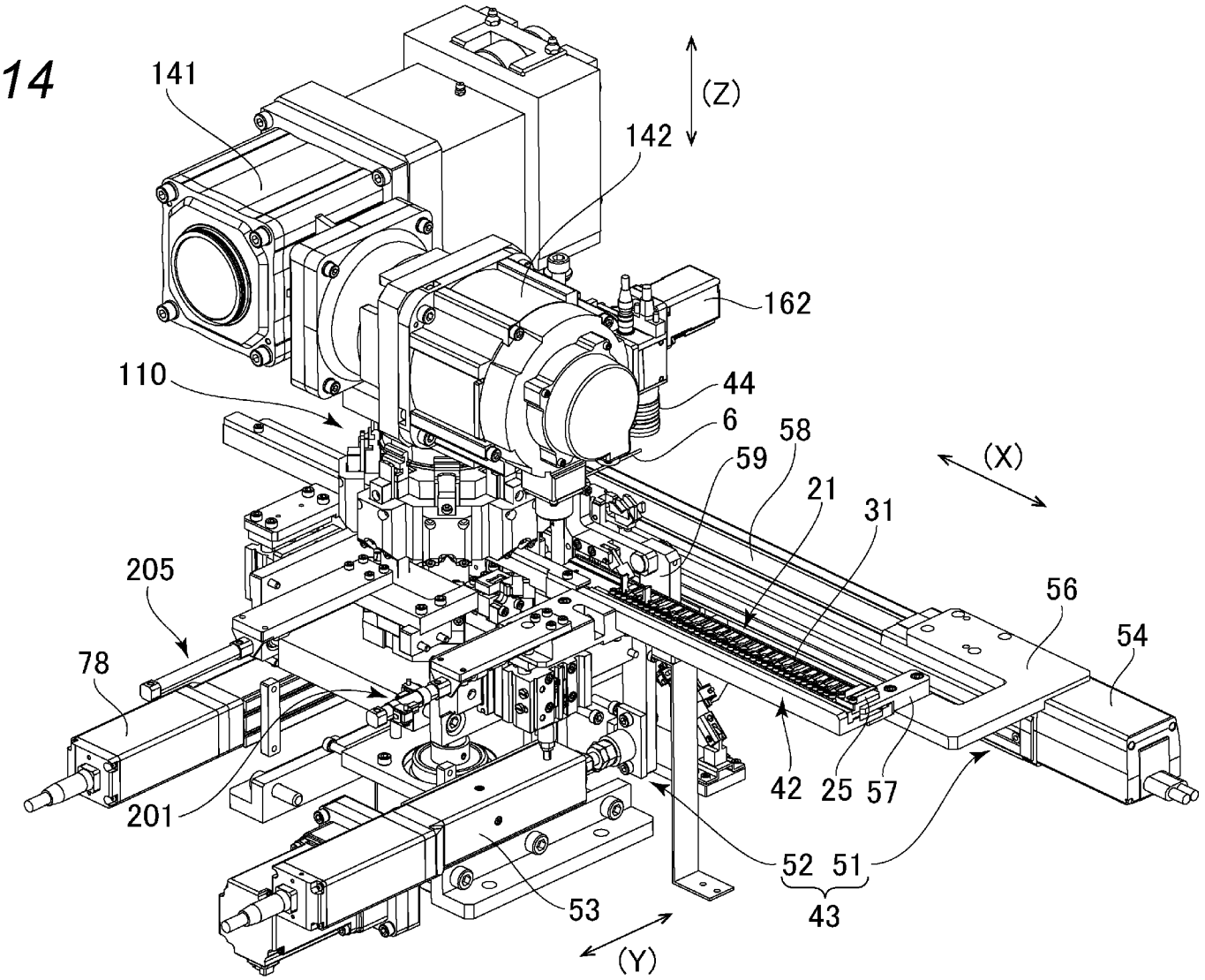
FIG. 14 is a perspective view of the principal constituent portions of the terminal crimping device according to the present embodiment when viewed from the rear side.

FIGS. 12 to 14 are perspective views illustrating principal components of the terminal crimping device 10 according to the present embodiment in each direction.

As illustrated in FIGS. 12 to 14, the terminal feeding mechanism 41 includes the slide rail 42, a horizontal movement mechanism (a position adjustment mechanism) 43, and a camera (a photographing device) 44.

The slide rail 42 is horizontally disposed in a terminal conveying direction (X) that is a leftward-rightward direction (a leftward-rightward direction in FIG. 3) of the terminal crimping device 10 to pass through the crimping position A. The terminal magazine 21 is placed on the slide rail 42 (see FIG. 5). A rail groove 45 is formed in the slide rail 42 in a longitudinal direction, and the projection 24 formed at the support 22 of the terminal magazine 21 is fitted into the rail groove 45 (see FIG. 5). Thereby, the terminal magazine 21 placed on the slide rail 42 is slidably supported in the longitudinal direction of the slide rail 42. In the slide rail 42, a portion including the crimping position A and its periphery is cut out.

The horizontal movement mechanism 43 includes a leftward-rightward movement mechanism part 51 and a forward-backward movement mechanism part 52. The leftward-rightward movement mechanism part 51 includes a slider 55, and the slider 55 is moved on a linear guide 58 by a servomotor 54 in the terminal conveying direction (X). A coupling plate 56 extending toward the slide rail 42 is fixed to the slider 55 (see FIG. 5). A coupling block 57 including a protrusion 57*a* on an upper surface thereof is fixed to the coupling plate 56. The engaging member 25 of the terminal magazine 21 placed on the slide rail 42 is disposed at an upper portion of the coupling block 57. The protrusion 57*a* of the coupling block 57 is engaged with the slit 25*a* of the engaging member 25.

Thereby, the terminal magazine 21 is coupled to be displaceable relative to the slider 55 in an electric wire feeding direction (Y) that is a forward-backward direction (a leftward-rightward direction in FIG. 4) of the terminal crimping device 10 and not to be displaceable relative to the slider 55 in the terminal conveying direction (X). The slider 55 is moved by the leftward-rightward movement mechanism part 51 in the terminal conveying direction (X), and thereby the terminal magazine 21 is moved in the terminal conveying direction (X) along with the slider 55. Thereby, the terminal fitting 1 (1*a* to 1*d*) held on the terminal holder 31 (31*a* to 31*d*) of the terminal magazine 21 is conveyed to the crimping position A.

The forward-backward movement mechanism part 52 includes a rail support 59 that is coupled to the slide rail 42, and an electric cylinder 53 that moves the rail support 59 in the electric wire feeding direction (Y). The electric cylinder 53 of the forward-backward movement mechanism part 52 moves the slide rail 42 via the rail support 59 in the electric wire feeding direction (Y) that is the forward-backward direction of the terminal crimping device 10. When the slide rail 42 is moved in the electric wire feeding direction (Y) by the forward-backward movement mechanism part 52, the terminal fitting 1 (1*a* to 1*d*), which is held on the terminal holder 31 (31*a* to 31*d*) of the terminal magazine 21 placed on the slide rail 42 and is displaced at the crimping position A, is displaced in the electric wire feeding direction (Y).

The camera 44 is a photographing device that photographs the electric wire connecting part 3 of the terminal fitting 1 (1*a* to 1*d*) disposed at the crimping position A. The camera 44 includes, for instance, an image pickup element such as a charge coupled device (CCD), and data of an image acquired by photographing the crimping position A is sent to the control device 12. The control device 12 controls the leftward-rightward movement mechanism part 51 and the forward-backward movement mechanism part 52 that constitute the horizontal movement mechanism 43 on the basis of the image photographed by the camera 44. Thereby, the electric wire connecting part 3 of the terminal fitting 1 (1*a* to 1*d*) is accurately positioned at a predetermined position of the crimping position A.

Figure 15:
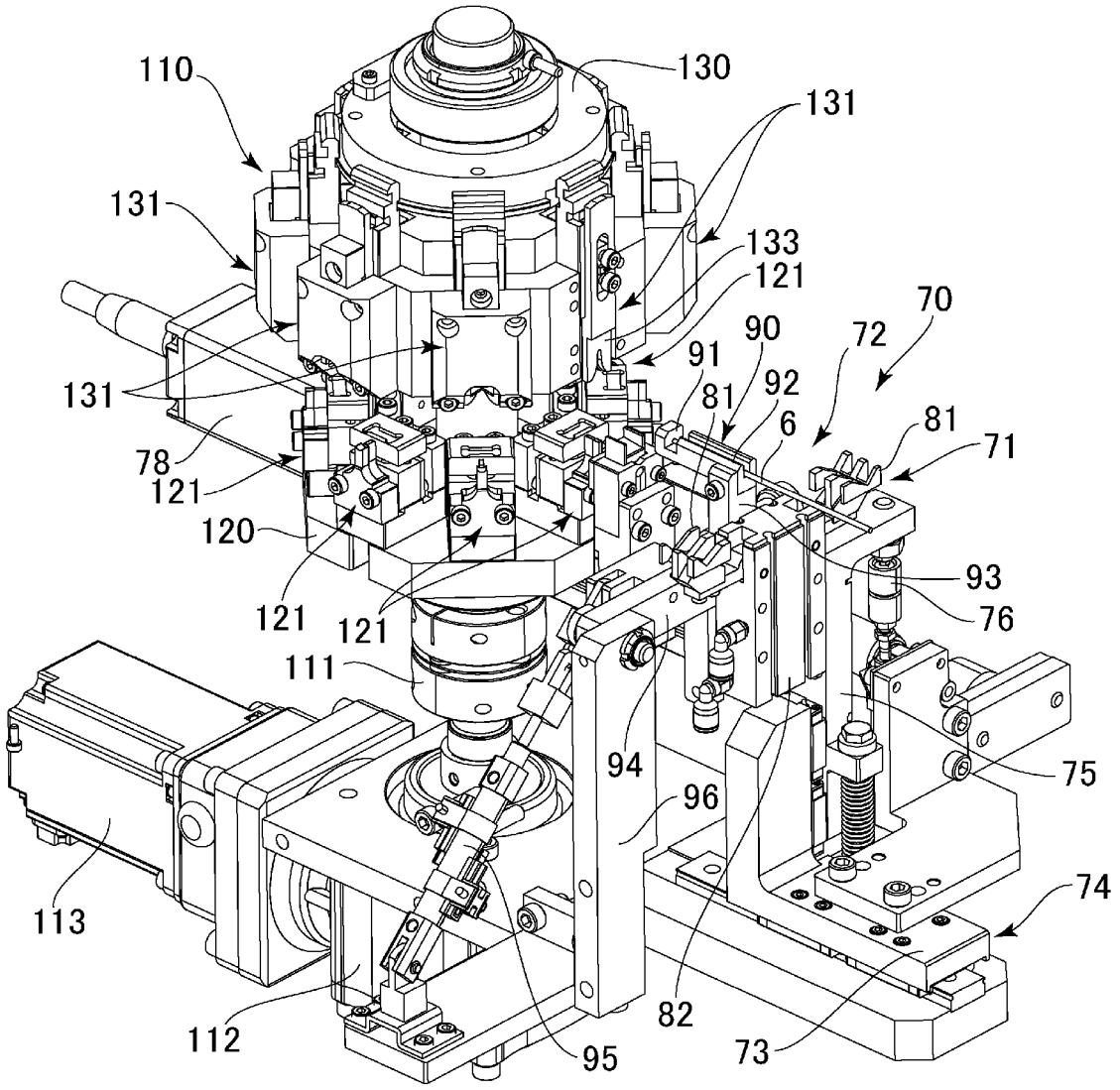
FIG. 15 is a perspective view of an electric wire feeding unit and a multi-applicator.
Figure 16:
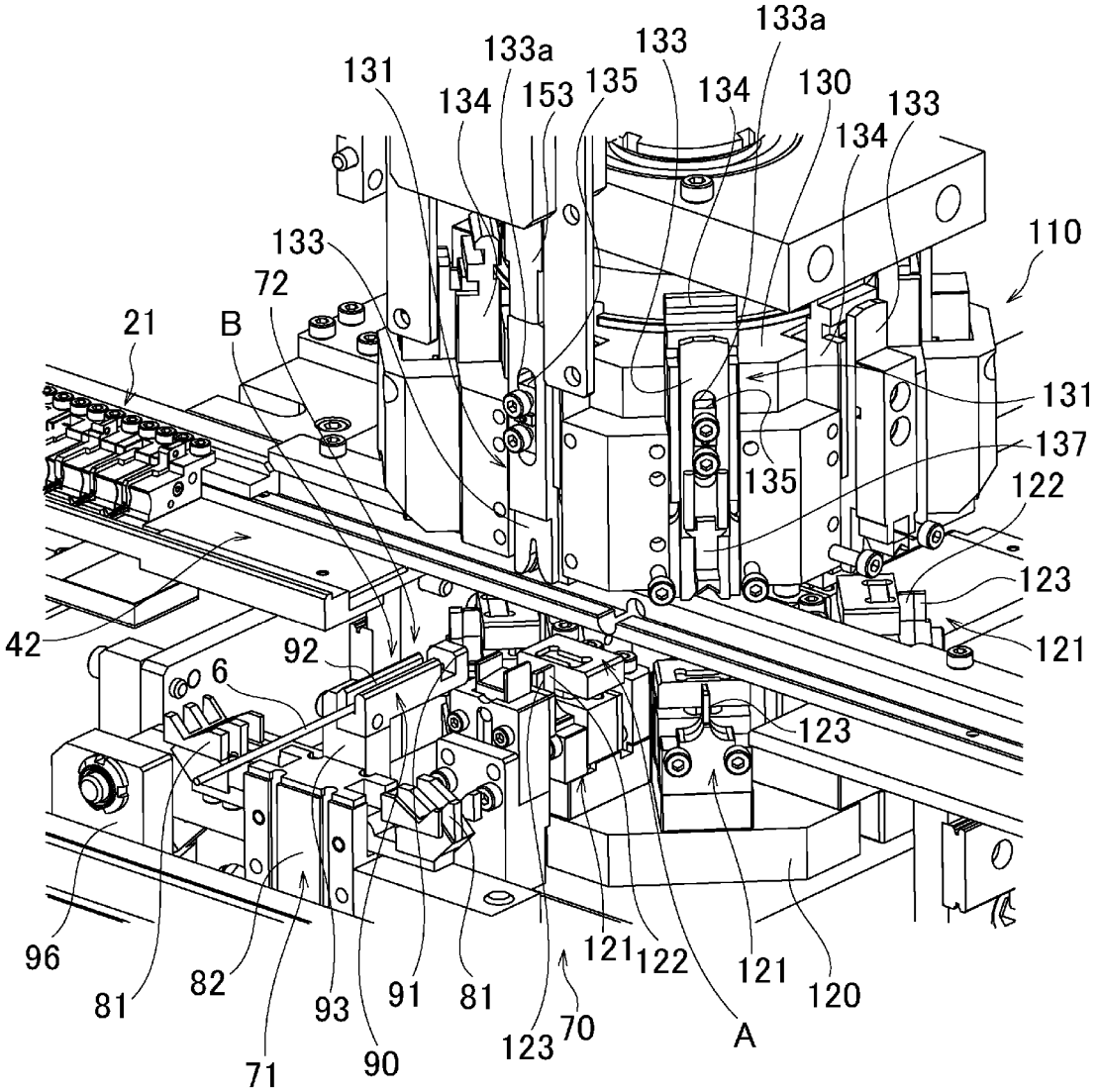
FIG. 16 is a perspective view of key parts when a crimping position is viewed from the right side.
Figure 17:
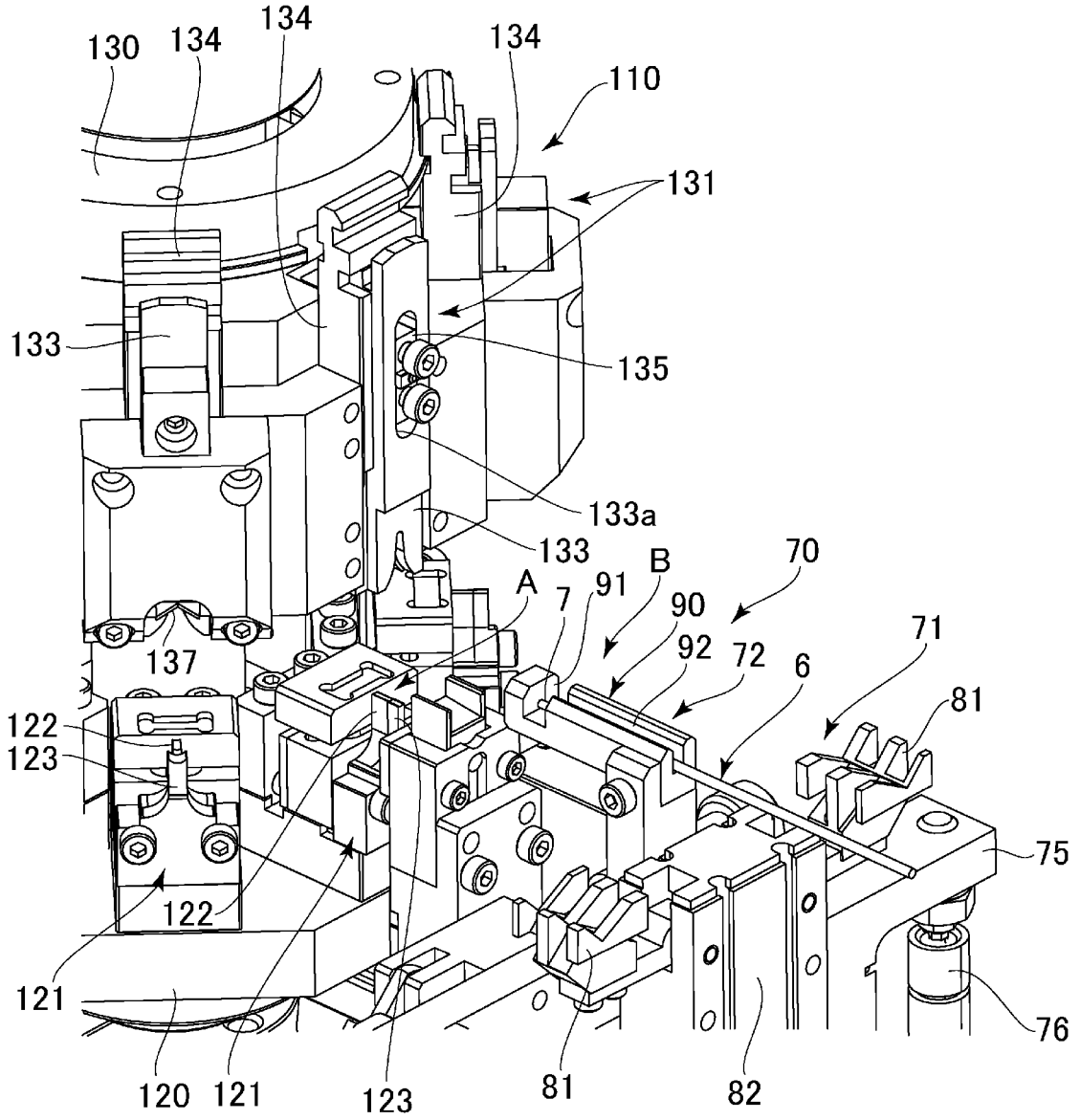
FIG. 17 is a perspective view of the key parts when the crimping position is viewed from the left side.
Figure 18:
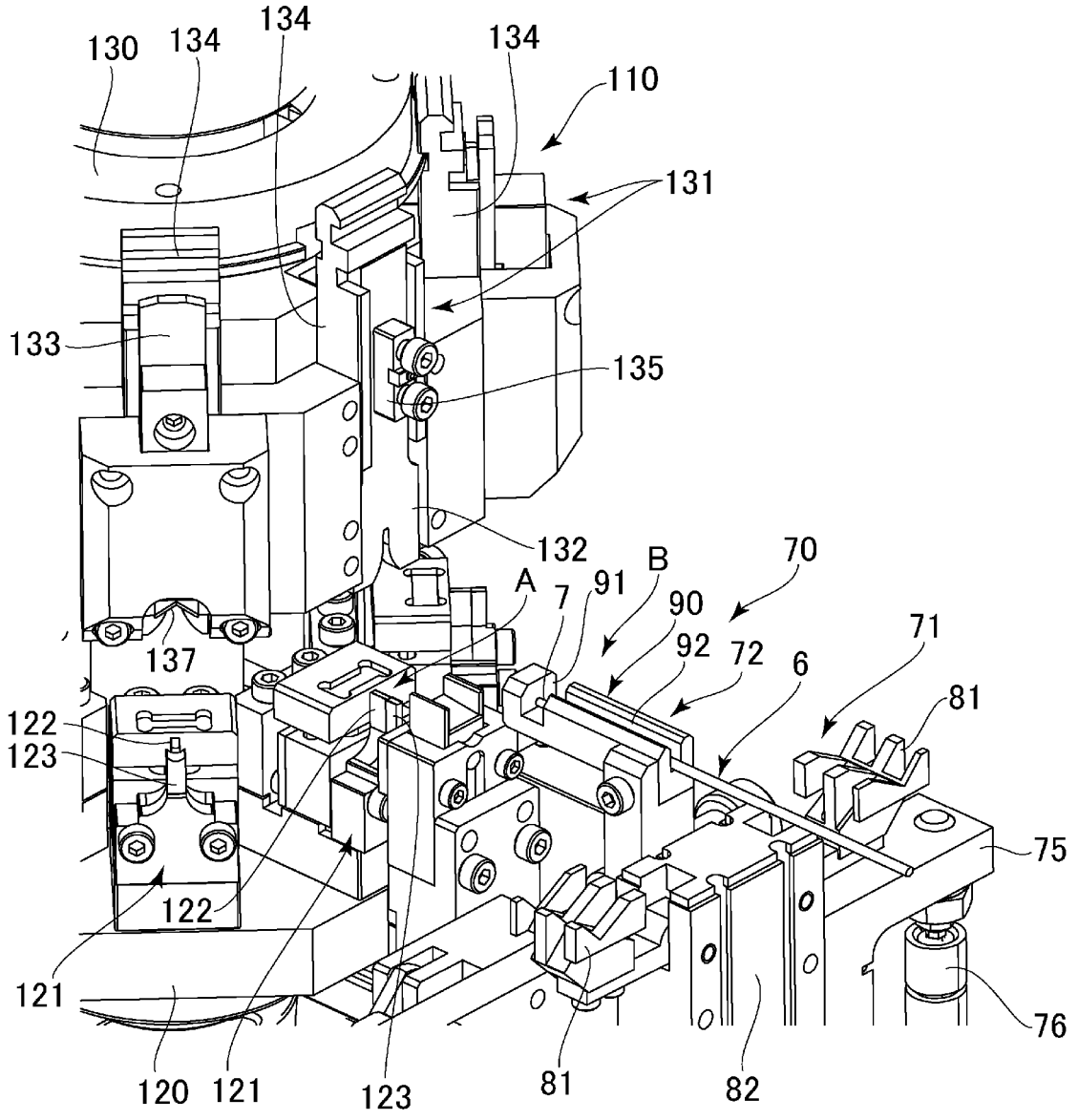
FIG. 18 is a perspective view of key parts in a state in which a sheath crimper illustrated in FIG. 17 is removed.

FIG. 15 is a perspective view of the electric wire feeding unit 70 and a multi-applicator 110, and FIG. 16 is a perspective view illustrating the crimping position when viewed from the right side. FIGS. 17 and 18 are perspective views illustrating the crimping position when viewed from the left side.

As illustrated in FIGS. 15 to 18, the electric wire feeding unit 70 includes an electric wire gripper 71 and an electric wire positioner 72. The electric wire gripper 71 is supported on a pedestal 73. The pedestal 73 slides to the electric wire feeding direction (Y) that is the forward-backward direction of the terminal crimping device 10 by a feed mechanism part 74 including an electric cylinder 78.

The electric wire gripper 71 is supported to be movable relative to the pedestal 73 via an angle 75 in an upward-downward direction (Z). An air cylinder 76 is provided between the pedestal 73 and the angle 75, and the electric wire gripper 71 is moved up and down by the air cylinder 76.

The electric wire gripper 71 includes a pair of gripping claws 81. The pair of gripping claws 81 is supported to be pivotable in directions in which they move toward or away from each other. These gripping claws 81 are opened or closed by an air cylinder 82. The gripping claws 81 are closed in a state in which the electric wire 6 is disposed between the gripping claws 81. Thereby, the electric wire 6 is gripped by the gripping claws 81, and the gripping claws 81 are opened, so that the gripping of the electric wire 6 is released.

As illustrated in FIG. 17, the electric wire positioner 72 is disposed at an electric wire positioning site B close to the crimping position A with respect to the electric wire gripper 71. The electric wire positioner 72 includes a positioning block 90. The positioning block 90 includes an electric wire abutting surface 91 and an electric wire housing groove 92. In the positioning block 90, the vicinity of an end of the electric wire 6 from which the conductor 7 is exposed is housed in the electric wire housing groove 92, and an end of the conductor 7 is brought into contact with the electric wire abutting surface 91. Thereby, the electric wire 6 that is set for the electric wire positioner 72 by a worker is disposed in the state of being positioned to the electric wire positioning site. The positioning block 90 is fixed to an oscillating end of a pivotal bar 94 via a fixing bar 93. The pivotal bar 94 is pivotably supported by a strut 96 erected on the mount 11. The electric wire positioner 72 includes an air cylinder 95 coupled to the mount 11 and the pivotal bar 94. The air cylinder 95 is driven, and thereby the pivotal bar 94 is pivoted. Thereby, the positioning block 90 is moved between the electric wire positioning site B and a retreat position deviated downward from the electric wire positioning site B.

As illustrated in FIGS. 12 to 14, the terminal crimping unit 100 includes a multi-applicator 110 and a pressing mechanism 140. The multi-applicator 110 and the pressing mechanism 140 are supported by the mount 11, and the pressing mechanism 140 is supported above the multi-applicator 110.

As illustrated in FIG. 15, the multi-applicator 110 includes a rotary shaft 111 supported in a vertical direction. A rotational driving motor 113 constituted of a servomotor is coupled to a lower end of the rotary shaft 111 via an orthogonal axis gear box 112. A rotational driving force of the rotational driving motor 113 is transmitted via the orthogonal axis gear box 112, and thereby the rotary shaft 111 is rotated.

The rotary shaft 111 includes an anvil supporting table 120 and a crimper supporting table 130. The crimper supporting table 130 is disposed at an upper side of the anvil supporting table 120. A plurality of anvils 121 (eight anvils 121 in this example) are provided on the anvil supporting table 120 at regular intervals in a circumferential direction. A plurality of crimpers 131 (eight crimpers 131 in this example) are provided on the crimper supporting table 130 at regular intervals in a circumferential direction. The anvils 121 and the crimpers 131 are disposed to be paired with each other at positions at which they are matched in a circumferential direction. In this way, the terminal crimping unit 100 includes the rotary type multi-applicator 110 including a plurality of pairs of anvils 121 and crimpers 131 on the rotary shaft 111.

As illustrated in FIGS. 16 to 18, a wire anvil 122 and a sheath anvil 123 are supported on the anvil 121. A wire crimper 132 and a sheath crimper 133 are provided on the crimper 131.

The wire crimper 132 and the sheath crimper 133 are mounted on a crimper holder 134. The crimper holder 134 is supported at the crimper 131 to be slidable in an upward-downward direction, and is always biased upward by a biasing member (not shown). Thereby, the wire crimper 132 and the sheath crimper 133 at the crimper 131 are separated from the wire anvil 122 and the sheath anvil 123 at the anvil 121. The wire crimper 132 is screwed to the crimper holder 134 via a slide block 135 that is engaged with a long hole 133*a* formed in the sheath crimper 133. The sheath crimper 133 is mounted to be slidable relative to the crimper holder 134 via the slide block 135. Thereby, the sheath crimper 133 is movable relative to the wire crimper 132 in the upward-downward direction. An electric wire pressing mechanism 137 for elastically pressing the electric wire 6 during swaging is provided at a front side of the sheath crimper 133.

In the multi-applicator 110, the rotary shaft 111 is rotated by the rotational driving motor 113, and any pair of anvil 121 and crimper 131 is disposed at the crimping position A. In this state, the wire anvil 122 and the sheath anvil 123 of the anvil 121 disposed close to the crimping position A are disposed below the crimping position A, and the wire crimpers 132 and the sheath crimpers 133 of the crimper 131 disposed close to the crimping position A are disposed above the crimping position A.

Figure 19:
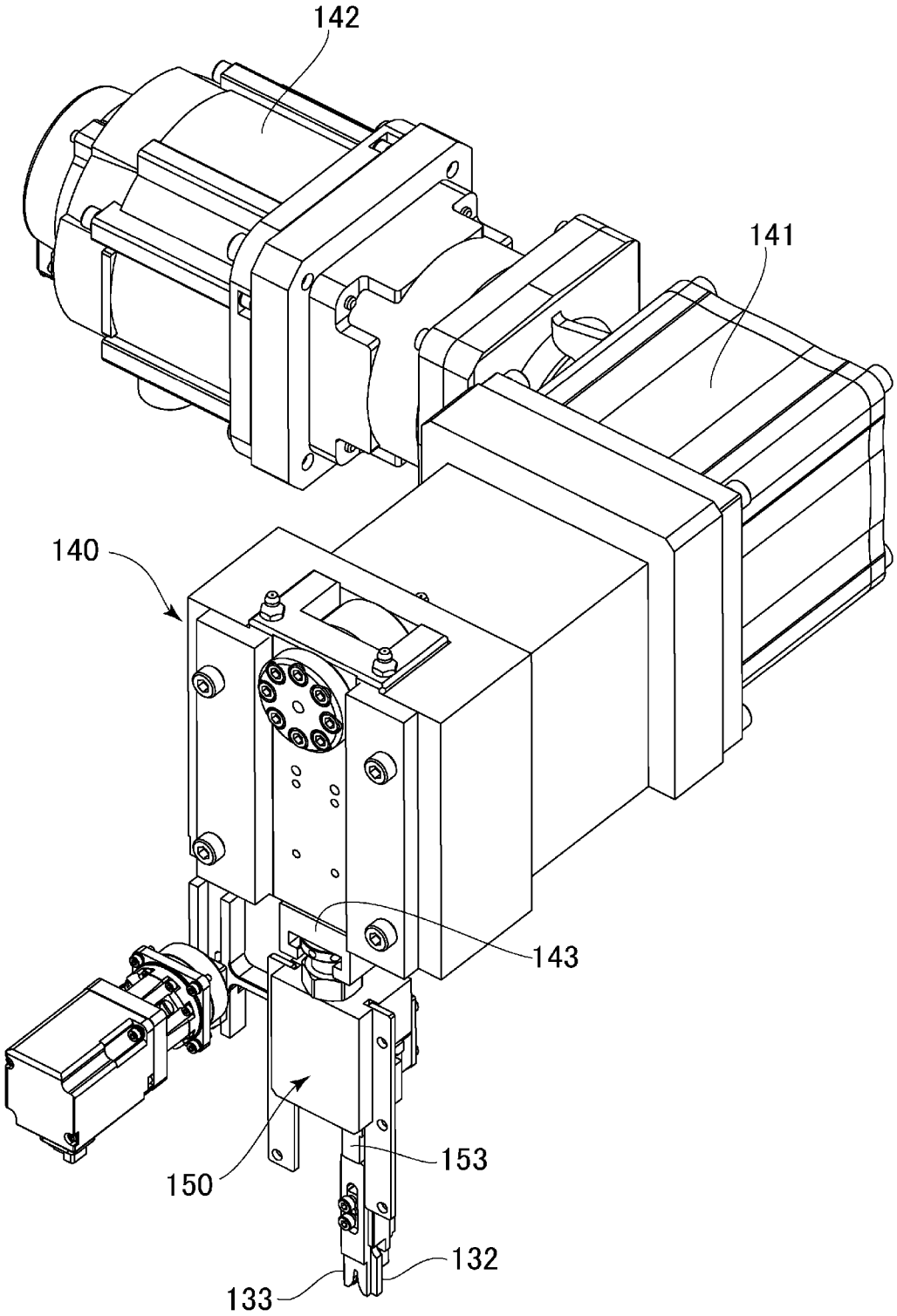
FIG. 19 is a perspective view of a pressing mechanism when viewed from the front side.
Figure 20:
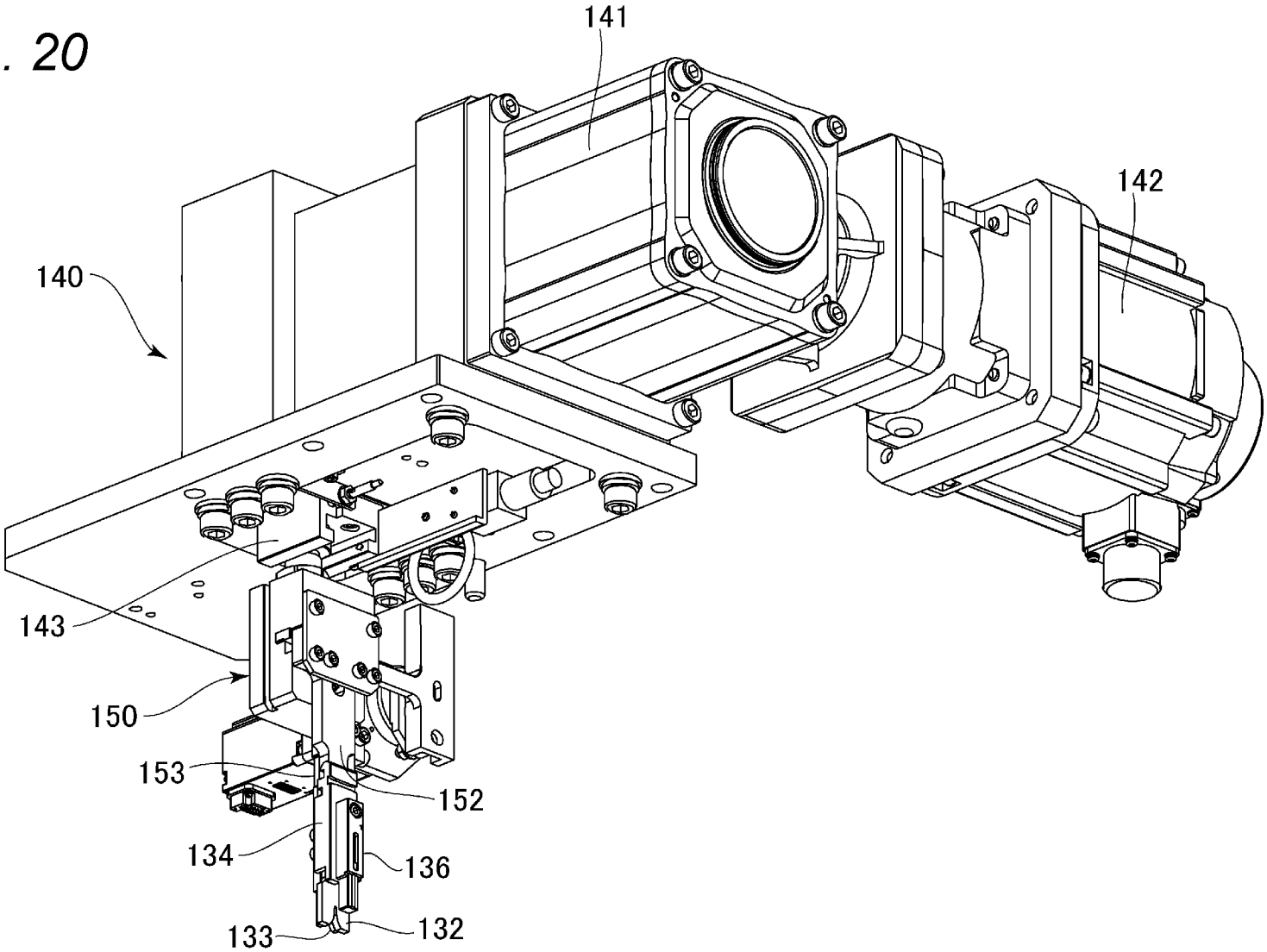
FIG. 20 is a perspective view of the pressing mechanism when viewed from the rear side.

FIGS. 19 and 20 are perspective views illustrating the pressing mechanism 140 when viewed from the front and rear sides.

As illustrated in FIGS. 19 and 20, a driving motor 142 constituted by a servomotor is coupled via an orthogonal axis gear box 141 in the pressing mechanism 140. In the pressing mechanism 140, a press ram 143 is coupled to a crankshaft (not shown) provided on an output shaft of the orthogonal axis gear box 141. A driving force of the driving motor 142 is transmitted via the orthogonal axis gear box 141 and the crankshaft, and thereby the press ram 143 is moved up and down.

A pressing block 150 is mounted at a lower portion of the press ram 143. A wire crimper pressing plate (a wire crimper pressing part) 152 and a sheath crimper pressing plate (a sheath crimper pressing part) 153 are mounted on the pressing block 150. The wire crimper pressing plate 152 is fixed to the pressing block 150 by screws.

A lower end of the wire crimper pressing plate 152 is engaged with an upper end of the crimper holder 134 disposed above the crimping position A. A lower end of the sheath crimper pressing plate 153 is disposed on an upper end of the sheath crimper 133 disposed above the crimping position A. A holder pressing mechanism 136 that elastically presses the locking plate 33 of the terminal holder 31 during swaging is provided on a rear side of the crimper holder 134.

Next, a terminal crimping method of crimping and connecting the terminal fitting 1 (1*a* to 1*d*) to the electric wire 6 using the terminal crimping device 10 having the above configuration will be described.

Setting of Terminal Fittings 1 to Terminal Magazine 21

The plurality of types of terminal fittings 1*a* to 1*d* to be crimped to the electric wires 6 are held on the terminal holders 31*a* to 31*d* mounted on the terminal magazine 21 (a terminal holding process). To be specific, the electric connecting parts 2 of the terminal fittings 1*a* to 1*d*, the types of which correspond to the holding grooves 34 of the holder blocks 32, are housed in the holding grooves 34 of the holder blocks 32 in a state in which the locking plates 33 of the terminal holders 31*a* to 31*d* are opened, and the tips thereof are brought into contact with the butting pins 37. Afterward, the locking plates 33 are pivoted and closed (see FIG. 7). With this configuration, the electric connecting parts 2 of the various types of terminal fittings 1*a* to 1*d* are held on the terminal holders 31*a* to 31*d*, and the electric wire connecting parts 3 are in the state of protruding laterally from the terminal holders 31*a* to 31*d* (see FIGS. 6 and 11).

Setting of Terminal Magazine 21 to Terminal Feeding Unit 20

The terminal magazine 21 in which the terminal fitting 1 (1*a* to 1*d*) is held on the terminal holder 31 (31*a* to 31*d*) is set to the slide rail 42 of the terminal feeding mechanism 41 constituting the terminal feeding unit 20. In this case, the projection 24 of the support 22 is fitted into the rail groove 45, and the slit 25*a* of the engaging member 25 is engaged with the protrusion 57*a* of the coupling block 57 (see FIG. 5). With this configuration, the terminal magazine 21 is slidably supported by the slide rail 42 of the terminal feeding mechanism 41, and the terminal magazine 21 is in the state of being coupled to the slider 55 of the horizontal movement mechanism 43 via the coupling plate 56.

Conveyance of Terminal Fittings 1

When the terminal magazine 21 is set to the terminal feeding mechanism 41 of the terminal feeding unit 20 and a crimping operation of the terminal fitting 1 (1*a* to 1*d*) using the terminal crimping device 10 is initiated, the slider 55 slides by means of the leftward-rightward movement mechanism part 51, and the terminal magazine 21 coupled to the slider 55 slides (moves) on the slide rail 42 toward the crimping position A in the terminal conveying direction (X) (a magazine moving process). Thereby, the terminal fitting 1 (1*a* to 1*d*) held on the terminal holder 31 (31*a* to 31*d*) of the terminal magazine 21 is conveyed toward the crimping position A, and the terminal fitting 1 (1*a* to 1*d*) to be crimped is disposed at the crimping position A.

Positioning of Terminal Fittings 1

Just before the terminal fitting 1 (1*a* to 1*d*) to be crimped is conveyed to the crimping position A, the electric wire connecting part 3 of the terminal fitting 1 (1*a* to 1*d*) is photographed from above by the camera 44 (a terminal photographing process).

As illustrated in FIG. 14, the air cylinder 201 fixed to the rail support 59 is disposed at a rear side of the slide rail 42 (a left side in FIG. 4) corresponding to a photographing range of the camera 44. The air cylinder 201 causes a pressing pin (not shown) to protrude to a front side of the slide rail 42, and presses and biases an upper side of a rear end of the locking plate 33 of the terminal holder 31 (31*a* to 31*d*) that holds the terminal fitting 1 (1*a* to 1*d*) to be photographed. Then, the locking plate 33 is pivoted in a closing direction, and looseness of the terminal fitting 1 (1*a* to 1*d*) housed in the holding groove 34 is removed. Therefore, the electric wire connecting part 3 of the terminal fitting 1 (1*a* to 1*d*) is photographed by the camera 44 with no sway.

Data of an image acquired by photographing the electric wire connecting part 3 of the terminal fitting 1 (1*a* to 1*d*) disposed at the crimping position A is sent from the camera 44 to the control device 12.

In the control device 12, a position shift from the crimping position A is examined for the electric wire connecting part 3 of the terminal fitting 1 (1*a* to 1*d*) on the basis of the image photographed by the camera 44 (a position shift examining process). For example, an amount of the position shift by which an edge position acting as the basis of the conductor crimping part 4 at the electric wire connecting part 3 is shifted from a predetermined position at the crimping position A is detected. As a result, when the position shift occurs at the electric wire connecting part 3, the control device 12 controls the horizontal movement mechanism 43 to correct the position shift from the predetermined position of the crimping position A of the electric wire connecting part 3, and performs a positioning process of adjusting a position of the terminal fitting 1 (1*a* to 1*d*) to the predetermined position of the crimping position A (a terminal positioning process). To be specific, a position of the terminal magazine 21 in the terminal conveying direction (X) is adjusted by the leftward-rightward movement mechanism part 51, and a position of the slide rail 42 in the electric wire feeding direction (Y) is adjusted by the forward-backward movement mechanism part 52. Thereby, the electric wire connecting part 3 of the terminal fitting 1 (1*a* to 1*d*) to be crimped is accurately disposed at the predetermined position of the crimping position A.

Selection of Applicator

When the crimping operation of the terminal fitting 1 (1*a* to 1*d*) using the terminal crimping device 10 is initiated, the pair of anvil 121 and crimper 131, which corresponds to the terminal fitting 1 (1*a* to 1*d*) to be crimped and is disposed at the crimping position A, is selected in the multi-applicator 110. Then, the rotational driving motor 113 is driven, the rotary shaft 111 is rotated, and the anvil 121 and the crimper 131 that have been selected are disposed at the crimping position A (an anvil and crimper disposing process). In this state, an upper end of the crimper holder 134 of the crimper 131 is engaged with a lower end of the wire crimper pressing plate 152, and a lower end of the sheath crimper pressing plate 153 is disposed on an upper end of the sheath crimper 133.

Feed of Electric Wire 6

A worker houses the end of the electric wire 6 from which the conductor 7 is exposed in the electric wire housing groove 92 of the positioning block 90, brings the end of the conductor 7 into contact with the electric wire abutting surface 91, positions the conductor 7 to the electric wire positioning site B, and initiates an electric wire feeding operation.

Then, the gripping claws 81 of the electric wire gripper 71 are closed by the air cylinder 82 in the electric wire feeding unit 70, and the electric wire 6 is gripped by the gripping claws 81. Then, the pivotal bar 94 is pivoted by the air cylinder 95, and the positioning block 90 moves to the retreat position deviated from the electric wire positioning site B.

The electric wire gripper 71 is moved toward the crimping position A in the electric wire feeding direction (Y) by the feed mechanism part 74, and is moved down by the air cylinder 76. The end of the electric wire 6 from which the conductor 7 is exposed is fed to the crimping position A, and is set on the electric wire connecting part 3 of the terminal fitting 1 (1*a* to 1*d*) (an electric wire setting process).

Crimping of Terminal Fittings 1

When the electric wire 6 is set on the electric wire connecting part 3 of the terminal fitting 1 (1*a* to 1*d*) at the crimping position A, the driving motor 142 of the pressing mechanism 140 in the terminal crimping unit 100 is driven, and the pressing block 150 is moved down along with the press ram 143.

Then, the wire crimper pressing plate 152 fixed to the pressing block 150 is moved down, and the wire crimper 132 fixed to the crimper holder 134 is pressed downward. When the pressing block 150 is moved down, the sheath crimper pressing plate 153 provided on the pressing block 150 is also moved down, and the sheath crimper 133 supported by the crimper holder 134 is pressed downward. Thereby, in the electric wire connecting part 3 of the terminal fitting 1 (1*a* to 1*d*) disposed at the crimping position A, the conductor crimping pieces 4*a* of the conductor crimping part 4 are clamped on the conductor 7 by the wire anvil 122 and the wire crimper 132, and the sheath crimping pieces 5*a* of the sheath crimping part 5 are clamped on the portion of the sheath 8 by the sheath anvil 123 and the sheath crimper 133 (a terminal swaging process). As a result, in the electric wire connecting part 3 of the terminal fitting 1 (1*a* to 1*d*), the conductor crimping part 4 is crimped on the conductor 7 of the electric wire 6, at the end of which is exposed, and the sheath crimping part 5 is crimpled to the portion of the sheath 8 of the electric wire 6. Thereby, the terminal fitting 1 (1*a* to 1*d*) is crimped and electrically connected to the electric wire 6.

When the crimping of the terminal fitting 1 (1*a* to 1*d*) to the electric wire 6 is completed, a hold-releasing pin (not shown) driven from a deep side of the crimping position A by an air cylinder 205 is projected, and a lower side of a rear end of the locking plate 33 of the terminal holder 31 (31*a* to 31*d*) that holds the crimped terminal fitting 1 (1*a* to 1*d*) is pressed and biased. Then, the locking plate 33 is pivoted and opened in an opening direction, and the crimped terminal fitting 1 (1*a* to 1*d*) can be taken out of the holding groove 34 of the holder block 32. Afterward, the crimping operation to the next terminal fitting 1 (1*a* to 1*d*) to be crimped is initiated in the terminal crimping device 10.

Meanwhile, as described above, the terminal fittings 1 (1*a* to 1*d*) crimped to the electric wires 6 are a plurality of types of terminal fittings that are different in width dimension W, height dimension H, length dimension L, or shape of the electric connecting part 2 (see FIG. 10). For this reason, in the conventional crimping machine that feeds terminal fittings wound around a reel in a state of being a chain terminal, to feed various terminal fittings, there was a need to install a plurality of feeders and reels for each type of terminal fittings, and an increase in size of a device and occupancy of an installation space were inevitable.

However, according to the terminal crimping device 10 and the terminal crimping method according to the present embodiment, the terminal magazine 21 in which the various terminal fittings 1*a* to 1*d* are held by the plurality of terminal holders 31*a* to 31*d* is mounted on the terminal feeding mechanism 41, and thereby the various terminal fittings 1*a* to 1*d* held on the terminal holders 31*a* to 31*d* are conveyed to the crimping position A and are sequentially crimped to the electric wires 6. Therefore, there is no need to install a plurality of feeders for feeding the terminal fittings 1*a* to 1*d* and a plurality of reels around which a chain terminal is wound for each type of terminal fittings 1*a* to 1*d*, so that the terminal crimping device 10 can be downsized, and the installation space can be reduced.

Among the plurality of pairs of anvils 121 and crimpers 131 provided in the multi-applicator 110, the pair of anvil 121 and crimper 131 corresponding to each of the terminal fittings 1*a* to 1*d* to be crimped is selected, and each of the terminal fittings 1*a* to 1*d* fed to the crimping position A is crimped to the electric wire 6 by the selected anvil 121 and crimper 131. Therefore, the plurality of types of terminal fittings 1*a* to 1*d* can be rapidly crimped to the electric wires 6, and productivity and quality can be improved even in the production of many kinds in small quantities.

The present invention is not limited to the aforementioned embodiment, and modifications, improvements, etc. are appropriately possible. In addition, a material, shape, dimensions, number, disposed place, etc. of each component in the aforementioned embodiment are arbitrary as long as the invention can be accomplished, and are not limited.

For example, when a posture such as an inclination of the electric wire connecting part 3 of the terminal fitting 1 (1*a* to 1*d*) is detected by the camera 44, and the electric wire connecting part 3 is inclined, the terminal crimping device 10 may be stopped, or a mechanism capable of adjusting an inclination of the terminal fitting 1 (1*a* to 1*d*) held on the terminal holder 31 (31*a* to 31*d*) may be provided to correct the inclination.

An automatic machine for holding the terminal fitting 1 (1*a* to 1*d*) on the terminal holder 31 (31*a* to 31*d*) of the terminal magazine 21 or an automatic machine for removing the sheath 8 at the end of the electric wire 6 to expose the conductor 7 and feeding the electric wire to the electric wire feeding unit 70 is provided, and thereby working efficiency can be further improved.

In the above embodiment, the terminal crimping device 10 made up of an automatic machine for automatically crimping the terminal fittings 1 to the electric wires 6 by pressing the crimper 131 toward the anvil 121 using the pressing mechanism 140 has been described by way of example. The terminal crimping device to which the invention is applied is not limited to the automatic machine. That is, the invention can also be applied to the terminal crimping device for manually crimping the terminal fittings 1 (1*a* to 1*d*) to the electric wires 6. Even in this case, there is no need to install a plurality of feeders for feeding the terminal fittings 1 (1*a* to 1*d*) and a plurality of reels around which the chain terminal is wound for each type of terminal fittings 1*a* to 1*d*, so that the manual terminal crimping device 10 can be downsized, and the installation space can be reduced.

Here, the features of the embodiments of the terminal crimping device and the terminal crimping method described above are briefly and collectively listed in [1] to [3] below.

[1] A terminal crimping device (10) for crimping a terminal fitting (1) disposed at a crimping position (A) to an electric wire (6), the terminal crimping device (10) including:

an anvil (121) disposed below the crimping position (A);

a crimper (131) disposed above the crimping position (A);

a pressing mechanism (140) configured to press down the crimper (131) to crimp the terminal fitting (1) to the electric wire (6) using the anvil (121) and the crimper (131); and a terminal feeding mechanism (41) configured to feed the terminal fitting (1) to the crimping position (A), wherein a terminal magazine (21) in which a plurality of terminal holders (31*a* to 31*d*) configured to respectively hold various types of the terminal fittings (1*a* to 1*d*) are arranged is detachably installed on the terminal feeding mechanism (41), and wherein the terminal feeding mechanism (41) moves the terminal magazine (21) to convey the terminal fittings (1*a* to 1*d*) held on the terminal holders (31*a* to 31*d*) to the crimping position (A).

[2] The terminal crimping device according to [1] above including:

a multi-applicator (110) including a plurality of pairs, each of the pairs including the anvil (121) and the crimper (131), configured to crimp a plurality of types of the terminal fittings (1*a* to 1*d*) to the electric wires (6), wherein the multi-applicator (110) is configured such that the pair of anvil (121) and crimper (131) corresponding to the terminal fitting (1) fed to the crimping position (A) is selected to be disposed at the crimping position (A).

[3] A terminal crimping method including:

holding a terminal fitting (1) to be crimped to an electric wire (6) on at least one terminal holder (31) mounted in a terminal magazine (21);

moving the terminal magazine (21) in which the terminal fitting (1) is held on the terminal holder (31) toward a crimping position (A) along a terminal conveying direction; and clamping an electric wire connecting part (3) of the terminal fitting (1) disposed at the crimping position (A) on an end of the electric wire (6) from which a conductor (7) is exposed with a pair of anvil (121) and crimper (131).

The invention claimed is:

1. A terminal crimping method comprising:

mounting at least one terminal holder of a plurality of terminal holders in a terminal magazine;

holding a terminal fitting of a plurality of terminal fittings to be crimped to an electric wire on the at least one terminal holder mounted in the terminal magazine, the electric wire including a conductor, the conductor having a sheathed portion and an exposed portion;

moving the terminal magazine in which the terminal fitting is held on the terminal holder to a crimping position along a terminal conveying direction; and clamping an electric wire connecting part of the terminal fitting disposed at the crimping position on an end of the electric wire having the exposed portion of the conductor with an anvil and crimper pair, wherein each of the plurality of terminal holders is configured to be detachable from the terminal magazine individually;

wherein each of the plurality of terminal holders is configured to hold only one terminal fitting of the plurality of terminal fittings;

wherein each of the plurality of terminal holders includes a holder block in which a holding groove is formed, the holding groove being configured to accommodate the terminal fitting;

wherein the step of holding includes inserting a butting pin into one of the holder blocks to cross the holding groove; and wherein an insertion position of the butting pin into one of the holder blocks depends on a type of the terminal fitting to be held on the terminal holder such that the butting pin is inserted into a first one of the holder blocks at a first insertion position when the type of the terminal fitting is of a first type, and the butting pin is inserted into a second one of the holder blocks at a second insertion position when the type of the terminal fitting is of a second type.

2. The terminal crimping method of claim 1, wherein the holding groove of each of the plurality of terminal holders is different from one another in width, depth, length or shape corresponding to each of the plurality of terminal fittings.

3. The terminal crimping method of claim 2, wherein each of the plurality of terminal holders further includes a locking plate corresponding to a holding groove provided in a corresponding one of the plurality of terminal holders.

4. The terminal crimping method according to claim 1, wherein the butting pin is configured to contact the terminal fitting accommodated in the holding groove such that a protrusion dimension of the terminal fitting from the first one or the second of the holder blocks is approximately the same across different types of terminal fittings.

5. The terminal crimping method of claim 3, wherein the holding groove and the locking plate of each of the plurality of terminal holders form a holding space, and wherein each holding space of the plurality of terminal holders is different from one another in width, depth, length or shape corresponding to each of the plurality of terminal fittings.

* * * * *